US005358652A

United States Patent [19]

Macpherson

[11] Patent Number: 5,358,652

[45] Date of Patent: Oct. 25, 1994

[54] INHIBITING HYDROLYTIC DEGRADATION OF HYDROLYZABLE OLEAGINOUS FLUIDS

[75] Inventor: Ian Macpherson, St. Louis, Mo.

[73] Assignee: Ethyl Petroleum Additives, Limited, Bracknell, England

[21] Appl. No.: 966,514

[22] Filed: Oct. 26, 1992

[51] Int. Cl.[5] ..... C10M 105/36; C10M 133/14

[52] U.S. Cl. ..... 252/51.5 R

[58] Field of Search ..... 252/51.5 R

[56] References Cited

U.S. PATENT DOCUMENTS

| | | | |
|---|---|---|---|
| 2,363,134 | 11/1944 | McCleary | 252/51.5 R |
| 2,408,090 | 10/1946 | Musher | 252/51.5 R |
| 2,453,850 | 11/1948 | Mikeska et al. | 252/51.5 R |
| 2,962,531 | 11/1960 | Coffield | 260/570.9 |
| 3,208,859 | 9/1965 | Coffield | 252/51.5 R |
| 3,822,284 | 7/1974 | Werzner et al. | 260/315 |

FOREIGN PATENT DOCUMENTS

| | | |
|---|---|---|
| 1299638 | 6/1962 | France . |
| 8805808 | 8/1988 | PCT Int'l Appl. . |
| 1180388 | 2/1970 | United Kingdom . |

*Primary Examiner*—Prince Willis, Jr.
*Assistant Examiner*—Cephia D. Toomer
*Attorney, Agent, or Firm*—John F. Sieberth

[57] ABSTRACT

Hydrolytic degradation of oleaginous fluids susceptible to hydrolytic degradation in the presence of moisture and the development of acidity in adventitious water are inhibited by including in the oleaginous fluids at least one oil-soluble compound containing at least one 3,5-dihydrocarbyl-4-hydroxybenzyl group attached to a primary, secondary or tertiary amino nitrogen atom, the two alpha-positions of the benzyl group being substituted by two hydrogen atoms, by two organic groups, or by one hydrogen atom and one organic group. Other phenolic compounds such as hindered phenolic antioxidants are incapable of providing such protection against hydrolytic degradation and acid buildup.

17 Claims, No Drawings

INHIBITING HYDROLYTIC DEGRADATION OF HYDROLYZABLE OLEAGINOUS FLUIDS

Natural and synthetic ester oils, such as oleaginous glycerides and other esters of lubricating viscosity are highly desired for use as base oils for lubricants and functional fluids such as hydraulic fluids, general purpose lubricants, transmission fluids, gear oils, and the like. See for example Pub. No. WO 88/05808. Unfortunately, however, many such oleaginous fluids are susceptible to hydrolytic degradation in the presence of moisture, especially at elevated temperatures. The resultant increase in acidity in the water which accumulates in the mechanical apparatus is of course highly detrimental.

EP 292 438 discloses that typical synthetic carboxylic ester base oils such as di(tridecyl) adipate and pentaerythritol tetra-ester derived from commercial mixed straight and branched chain $C_5$, $C_7$, and $C_8$ acids can be stabilized against hydrolysis by use of certain urea and semicarbazone derivatives, such as oleyl urea and phenyl urea, as additives to the oil.

This invention involves the discovery, inter alia, that increases in water acidity in oleaginous fluid-containing apparatus or systems into which water can ingress can be effectively inhibited by adding to the oleaginous fluid, as a hydrolytic stabilizer, a minor amount of at least one oil-soluble compound containing at least one 3,5-dihydrocarbyl-4-hydroxybenzyl group attached to a primary, secondary or tertiary amino nitrogen atom. In such compounds the two alpha-positions of the benzyl group are substituted by two hydrogen atoms, by two organic groups, or by one hydrogen atom and one organic group. For convenience, such hydrolytic stabilizers are frequently referred to hereinafter as "hydroxybenzyl hydrolysis inhibitors". The hydroxybenzyl hydrolysis inhibitors used pursuant to this invention can be employed individually or in combinations of two or more such compounds. A particularly preferred compound for this use is available commercially as Hi-TEC® 4703 additive (Ethyl Petroleum Additives, Inc.; Ethyl Petroleum Additives, Ltd.; Ethyl S. A.; Ethyl Canada Limited) and ETHYL® 703 antioxidant (Ethyl Corporation; Ethyl S. A.; Ethyl Canada Limited).

A feature of this invention is that although a number of 3,5-dihydrocarbyl-4-hydroxybenzylamines have long been known as antioxidants (note U.S. Pat. No. 2,962,531 and EP 292 438), so far as is presently known, this is the first time such compounds have been discovered to be effective as stabilizers against hydrolytic degradation and generation of acidified water in apparatus or systems containing a water-hydrolyzable oleaginous fluid and into which water can ingress. This is deemed a surprising, wholly unprecedented discovery because so far as is presently known, all other types of phenolic antioxidants which do not possess the structural characteristics of the hydroxybenzyl hydrolysis inhibitors of this invention are incapable of effectively protecting water-hydrolyzable oleaginous fluids against hydrolytic degradation and increased acidity in adventitious water.

Another feature of this invention is the further discovery that lecithin, a component in some natural triglyceride oils such as certain rapeseed oils, tends to promote hydrolytic degradation of the base oil. Yet, the hydroxybenzyl hydrolysis inhibitors of this invention are capable of effectively suppressing hydrolytic degradation in lecithin-containing glyceride oils as well as in glyceride oils which do not contain lecithin.

Still another feature of this invention is that the hydroxybenzyl hydrolysis inhibitors are capable of effectively suppressing hydrolytic degradation in natural and synthetic ester oils (including glyceride oils) even when such oils contain multi-component additive packages used for imparting other beneficial properties to the base oil.

Accordingly, this invention provides in one of its embodiments a lubricant or functional fluid composition which comprises:

a) a major proportion of a hydrolyzable oleaginous fluid; and b) as a hydrolytic stabilizer and inhibitor of acidity build-up in adventitious water, a minor amount of at least one oil-soluble compound containing at least one 3,5-dihydrocarbyl-4-hydroxybenzyl group attached to a primary, secondary or tertiary amino nitrogen atom, the two alpha-positions of the benzyl group being substituted by two hydrogen atoms, by two organic groups, or by one hydrogen atom and one organic group, said oil-soluble compound stabilizing said composition against hydrolytic degradation in the presence of moisture.

Another embodiment of this invention is a method of inhibiting hydrolytic degradation of a hydrolyzable oleaginous lubricant or functional fluid composition in the presence of moisture, which method comprises including in said composition, a minor amount of at least one oil-soluble compound containing at least one 3,5-dihydrocarbyl-4-hydroxybenzyl group attached to a primary, secondary or tertiary amino nitrogen atom, the two alpha-positions of the benzyl group being substituted by two hydrogen atoms, by two organic groups, or by one hydrogen atom and one organic group, whereby said composition is stabilized against hydrolytic degradation and acid formation in the presence of adventitious water.

Another embodiment this invention provides mechanical apparatus, preferably but not necessarily a hydraulic system, susceptible to the ingress of water and containing a lubricant or functional fluid composition comprising a major proportion of an oleaginous base oil susceptible to hydrolytic degradation in the presence of water, said lubricant or functional fluid composition containing as a hydrolytic stabilizer and inhibitor of acid formation in the presence of adventitious water, a minor amount of at least one oil-soluble compound containing at least one 3,5-dihydrocarbyl-4-hydroxybenzyl group attached to a primary, secondary or tertiary amino nitrogen atom, the two alpha-positions of the benzyl group being substituted by two hydrogen atoms, by two organic groups, or by one hydrogen atom and one organic group, whereby said composition is stabilized against hydrolytic degradation and acid formation in the presence of adventitious water.

The hydroxybenzyl hydrolysis inhibitors of this invention are used in the base oil in an amount effective to prevent, suppress or inhibit hydrolytic degradation of the base oil. Thus the amount in any given situation is dependent upon the identity and composition of the base oil or base oil blend being employed; the identity, composition and concentration(s) of the other additive(s) being employed in forming the finished lubricant or functional fluid; and the severity of the service conditions to which the finished lubricant or functional fluid is likely to be subjected.

A convenient procedure for assessing hydrolytic degradation is the ASTM test procedure D 2619, a standard method for determining hydrolytic stability. A sample of 75 grams of the fluid to be tested plus 25 grams of water and a copper test specimen are sealed in a pressure-type beverage bottle. The bottle is rotated, end over end, for 48 hours in an oven at 93° C. At the end of the test, the layers are separated and the oil layer is water washed. The filtered water layer and the water washings are combined and the total acidity of the resultant water mixture is determined by titration with 0.1N KOH to a phenolphthalein end-point. The total acidity of the water mixture (hereinafter referred to as the aqueous layer) is expressed in terms of mg of KOH. For the purposes of this invention, the most useful criterion of hydrolytic stability or instability is the total acidity of the aqueous layer from the ASTM D 2619 test, expressed in mg of KOH.

There is no hard and fast rule as to whether a fluid does or does not possess satisfactory hydrolytic stability. For some applications a fluid which yields, in the ASTM D 2619 test, an aqueous layer having a total acidity of 6 mg KOH or less may be satisfactory. On the other hand, fluids yielding aqueous layers of not more than 4, or more than 3 or even more than 0.5 mg KOH total acidity may be necessary for other applications. Indeed there can be instances where any measureable total acidity can be undesirable. The practice of this invention provides a reduction in total acidity of the aqueous layer in the ASTM D 2619 test sufficient to satisfy most, if not all, reasonable requirements, including the achievement of values such as set forth in this paragraph. Oils having poor hydrolytic stability can cause serious problems when used under damp conditions for prolonged periods. The amount of additive(s) used in the base oil will typically provide a minor amount of up to about 5,000 ppm of nitrogen as a hydroxybenzyl hydrolysis inhibitor dissolved in the oil, based on the total weight of the finished composition including the hydroxybenzyl hydrolysis inhibitor(s). Normally the finished composition will contain at least 5 ppm, preferably up to 1,000 ppm, and most preferably from 25 to 250 ppm of nitrogen as a hydroxybenzyl hydrolysis inhibitor of this invention.

In preferred embodiments, the base oil is biodegradable. By "biodegradable" is meant that the substance undergoes at least 10%, more preferably at least 25% most preferably at least 70%, degradation when subjected to the CEC L33 T82 test.

Other preferred embodiments of this invention involve the provision of ashless additive packages and ashless lubricant or functional fluid compositions, i.e., compositions which are essentially free of metal-containing additive components. By "essentially free" in this connection is meant that the finished oil composition preferably contains no more than 100 ppm by weight of metal in the form of metal-containing additive components. Compositions which are essentially free of metals such as zinc are advantageous in that they have improved filterability. Moreover additives such as zinc dihydrocarbyl dithiophosphates often exhibit limited antiwear and/or extreme pressure effectiveness, and are undesirable because of environmental considerations. It will of course be understood and appreciated that boron-containing components and/or phosphorus-containing components can be, and preferably are, included in the compositions of this invention inasmuch as neither boron nor phosphorus is considered in the chemical arts to be a metal.

Because of performance, environmental and conservational concerns it is desirable to employ additive components which contain little, if any, halogen atoms such as chlorine atoms. Thus, in order to satisfy such concerns, this invention provides in accordance with additional preferred embodiments, compositions which are essentially free of halogen-containing additive components. By "essentially free" in this connection is meant that the finished oil composition preferably contains no more than 100 ppm by weight of halogen (e.g., chlorine) in the form of halogen-containing additive components. Indeed, the lower the halogen content, if any, the better. Thus finished oils containing at most 10 ppm of halogen are preferred. Finished oils devoid of more than trace quantities of halogen-containing components or impurities are most preferred.

Accordingly, preferred embodiments of this invention provide additive packages or concentrates which, when dissolved in a metal-free and halogen-free base oil at a concentration of hydroxybenzyl hydrolysis inhibitors of this invention of 10% by weight, yield an oleaginous composition in which on a weight basis the total metal content, if any, is 100 ppm or less, preferably 50 ppm or less, and most preferably 10 ppm or less, and in which the total halogen content, if any, is 100 ppm or less, preferably 50 ppm or less, more preferably 10 ppm or less, and most preferable 1 ppm or less.

Particularly preferred additive combinations of this invention are the following:

a) A combination of (i) at least one oil-soluble hydroxybenzyl hydrolysis inhibitor of this invention and (ii) at least one oil-soluble rust inhibitor, in proportions such that per part by weight of (i) there are from 0.001 to 25 and preferably from 0.01 to 10 parts by weight of (ii).

b) A combination of (i) at least one oil-soluble hydroxybenzyl hydrolysis inhibitor of this invention, (ii) at least one oil-soluble rust inhibitor, and (iii) at least one oil-soluble antioxidant, most preferably a combination of at least one oil-soluble phenolic antioxidant and at least one oil-soluble aromatic amine antioxidant, in proportions such that per part by weight of (i) there are from 0.001 to 25 and preferably from 0.01 to 10 parts by weight of (ii); and from 0.01 to 100 and preferably from 0.1 to 50 parts by weight of (iii).

c) A combination of (i) at least one oil-soluble hydroxybenzyl hydrolysis inhibitor of this invention, (ii) at least one oil-soluble rust inhibitor, (iii) at least one oil-soluble antioxidant, most preferably a combination of at least one oil-soluble phenolic antioxidant and at least one oil-soluble aromatic amine antioxidant, and (iv) at least one oil-soluble phosphorus-containing and/or sulphur-containing antiwear and/or extreme pressure agent, most preferably a metal-free oil-soluble phosphorus- and nitrogen-containing and/or a sulphur-containing antiwear and/or extreme pressure agent, in proportions such that per part by weight of (i) there are from 0.001 to 25 and preferably from 0.01 to 10 parts by weight of (ii); from 0.01 to 100 and preferably from 0.1 to 50 parts by weight of (iii); and from 0.01 to 100 and preferably from 0.05 to 20 parts by weight of (iv).

d) A combination of (i) at least one oil-soluble hydroxybenzyl hydrolysis inhibitor of this invention, (ii) at least one oil-soluble rust inhibitor, (iii) at least one oil-soluble antioxidant, most preferably a combination of at least one oil-soluble phenolic antioxidant and at least one oil-soluble aromatic amine antioxidant, (iv) at least one oil-soluble phosphorus-containing and/or sulphur-containing antiwear and/or extreme pressure agent, most preferably a metal-free oil-soluble phosphorus- and nitrogen-containing and/or a sulphur-containing antiwear and/or extreme pressure agent, and (v) at least one oil-soluble copper corrosion inhibitor, most preferably one or more thiazoles and/or triazoles, in proportions such that per part by weight of (i) there are from 0.001 to 25 and preferably from 0.01 to 10 parts by weight of (ii); from 0.01 to 100 and preferably from 0.1 to 50 parts by weight of (iii); from 0.01 to 100 and preferably from 0.05 to 20 parts by weight of (iv); and from 0.0001 to 1 and preferably from 0.001 to 0.5 part by weight of (v).

Some typical hydroxybenzyl hydrolysis inhibitors that can be used in the practice of this invention are described in U.S. Pat. No. 2,962,531. However as extensive as that disclosure is, it serves to illustrate but a mere fraction of the tremendous number of hydroxybenzyl hydrolysis inhibitors which can be used in the practice of this invention. In general, the hydroxybenzyl hydrolysis inhibitors of this invention are oil-soluble compounds of the formula

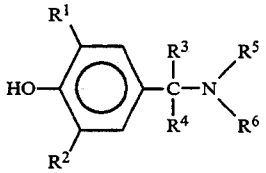

wherein each of $R^1$ and $R^2$ is, independently, a hydrocarbyl group, preferably an alkyl group, and most preferably a tertiary alkyl group of 4 to 12 carbon atoms; and each of $R^3$, $R^4$, $R^5$ and $R^6$ is, independently, a hydrogen atom or an organic group bonded to the compound by means of a carbon-to-carbon single bond. Optionally, the 2- or the 2- and 6-positions of the 4-hydroxybenzyl group(s) in the compound can be substituted with relatively small hydrocarbyl substituents which do not sterically hinder the adjacent 3- or 3- and 5-positions, such as primary lower alkyl groups (methyl, ethyl, etc.). A few examples illustrating the vast array of hydroxybenzyl hydrolysis inhibitors usable in the practice of this invention include, but are not limited to, the following: 2,6-di-tert-butyl-α-dimethylamino-p-cresol, α,α'-(methylimino)bis(2,6-di-tert-butyl-p-cresol), 2,6-di-tert-butyl-α-morpholino-p-cresol, α,α'-(2,6-diethylphenylimino)bis(2,6-di-tert-butyl-p-cresol), 4,4'-(anilinomethylene)bis(2,6-di-tert-butylphenol), α,α',α''-nitrilotris(2,6-di-tert-butyl-p-cresol), 2,6-di-tert-butyl-α-tertbutylamino-p-cresol, 2,2'-(3,5-di-tert-butyl-4-hydroxybenzylbenzylimino)-diethanol, α,α'-(1,4-piperazinediyl)bis(2,6-di-tert-butyl-p-cresol), 1,1'-(3,5-di-tert-butyl-4-hydroxybenzylimino)di-2-ethylhexene, 1,1'-(3,5-tert-butyl-4-hydroxybenzylimino)dicyclohexane, 2,6-di-tert-butyl-α-(4-methyl-1-piperazinyl)-p-cresol, α,α',α'',α'''-(ethylenedinitrilo)tetrakis(2,6-di-tert-butyl-p-cresol), α-(p-anilinoanilino)-2,6-di-tert-butyl-p-cresol, N,N,N'-tris(3,5-di-tert-butyl-4-hydroxybenzyl)ethylenediamine, 1-dimethylamino-1-(3,5-di-tert-butyl-4-hydroxyphenyl)-2-butene, α,α'-(N-decylimino)bis(2,6-di-tert-butyl-p-cresol), 1,3,5-tris(3,5-di-tert-butyl-4-hydroxybenzyl)-2,4,6-trimethyl-hexahydrotriazine, N-methyl-N-(3,5-di-tert-butyl-4-hydroxybenzyl)ethanol amine, 1-dimorpholinomethyl-(3,5-di-tert-butyl-4-hydroxybenzene, 2-tert-butyl-6-methyl-α-di-methylamino-p-cresol, α,α'-(methylimino)bis(2-tert-butyl-6-methyl-p-cresol), 2-tert-butyl-6-methyl-α-morpholino-p-cresol, α,α'-(2,6-diethylphenylimino)bis(2-tert-butyl-6-methyl-p-cresol), 4,4'-(anilinomethylene)-bis(2-tert-butyl-o-cresol), α,α',α''-nitrilotris(2-tert-butyl-6-methyl-p-cresol), 2-tert-butyl-6-methyl-α-tert-butyl-amino-p-cresol, 2,2'-(3-tert-butyl-5-methyl-4-hydroxybenzylimino)-diethanol, α,α'-(1,4-piperazinediyl)bis(2-tert-butyl-6-methyl-p-cresol), 1,1'-(3-tert-butyl-5-methyl-4-hydroxybenzylimino)di-2-ethylhexene, 1,1'-(3-tert-butyl-5-methyl-4-hydroxybenzylimino)dicyclohexane, 2-tert-butyl-6-methyl-α-(4-methyl-1-piperazinyl)-p-cresol, α,α',α'',α'''-(ethylenedinitrilo)tetrakis(2-tert-butyl-6-methyl-p-cresol), α-(p-anilinoanilino)-2-tert-butyl-6-methyl-p-cresol, N,N,N'-tris(3-tert-butyl-5-methyl-4-hydroxybenzyl)ethylenediamine, 1-dimethylamino-1-(3-tert-butyl-5-methyl-4-hydroxy-phenyl)-2-butene, α,α'-(N-decylimino)bis(2-tert-butyl-6-methyl-p-cresol), 1,3,5-tris(3-tert-butyl-5-methyl-4-hydroxybenzyl)-2,4,6-trimethyl-hexahydrotriazine, N-methyl-N-(3-tert-butyl-5-methyl-4-hydroxybenzyl)ethanol amine, 1-dimorpholinomethyl-(3-tert-butyl-5-methyl-4-hydroxybenzene, 2,6-di-(1,1,3,3-tetramethylbutyl)-α-dimethylamino-p-cresol, α,α'-(methylimino)bis(2,6-di-(1,1,3,3-tetramethylbutyl)-p-cresol), 2,6-di-(1,1,3,3-tetramethylbutyl)-α-morpholino-p-cresol, α,α'-(2,6-diethylphenylimino)bis(2,6-di-(1,1,3,3-tetramethylbutyl)-p-cresol), 4,4'-(anilinomethylene)bis(2,6-di-(1,1,3,3-tetramethylbutyl)phenol), α,α',α''-nitrilo-tris(2,6-di-(1,1,3,3-tetramethylbutyl)-p-cresol), 2,6-di-(1,1,3,3-tetramethylbutyl)-α-(1,1,3,3-tetramethylbutyl)amino-p-cresol, 2,2'-(3,5-di-(1,1,3,3-tetramethylbutyl)-4-hydroxybenzylimino)diethanol, α,α'-(1,4-piperazinediyl)-bis(2,6-di-(1,1,3,3-tetramethylbutyl)-p-cresol), 1,1'-(3,5-di-(1,1,3,3-tetramethylbutyl)-4-hydroxybenzylimino)di-2-ethylhexene, 1,1'-(3,5-(1,1,3,3-tetramethylbutyl)-4-hydroxybenzylimino)dicyclohexane, 2,6-di-(1,1,3,3 -tetramethylbutyl)-α-(4-methyl-1-piperazinyl)-p-cresol, α,α',α'',α'''-(ethylenedinitrilo)tetrakis(2,6-di-(1,1,3,3-tetramethylbutyl)-p-cresol), α-(p-anilinoanilino) -2,6-di-(1,1,3,3-tetramethylbutyl)-p-cresol, N,N,N'-tris(3,5-di-(1,1,3,3-tetramethylbutyl)-4-hydroxybenzyl)ethylenediamine, 1-dimethylamino-1-(3,5-di-(1,1,3,3-tetramethylbutyl)-4-hydroxyphenyl)-2-butene, α,α'-(N-decylimino)bis(2,6-di-(1,1,3,3-tetramethylbutyl)-p-cresol), 1,3,5-tris(3,5-di-(1,1,3,3-tetramethylbutyl)-4-hydroxybenzyl)-2,4,6-trimethyl-hexahydrotriazine, N-methyl-N-(3,5-di-(1,1,3,3-tetramethylbutyl)-4-hydroxybenzyl)ethanol amine, 1-dimorpholinomethyl-(3,5-di-(1,1,3,3-tetramethylbutyl)-4-hydroxybenzene, 2,6-diisopropyl-α-dimethylamino-p-cresol, α,α'-(methylimino)-bis(2,6-diisopropyl-p-cresol), 2,6-diisopropyl-α-morpholino-p-cresol, α,α'-(2,6-diethylphenylimino)bis(2,6-diisopropyl-p-cresol), 4,4'-(anilinomethylene)bis(2,6-diisopropylphenol), α,α',α''-nitrilotris(2,6-diisopropyl-p-cresol), 2,6-diisopropyl-α-tert-butylamino-p-cresol, 2,2'-(3,5-diisopropyl-4-hydroxybenzylimino)diethanol, α,α'-(1,4-piperazinediyl)bis(2,6-diisopropyl-p-cresol), 1,1'-(3,5-diisopropyl-4-hydroxybenzylimino)di-2-ethylhexene, 1,1'-(3,5-diisopropyl-4-hydroxybenzylimino)- dicyclohexane, 2,6-diisopropyl-α-(4-methyl-1-piperazinyl)-p-cresol, α,α',α'',α'''-(ethylenedinitrilo)tetrakis(2,6-di-isopropyl-p-cresol), α-(p-anilinoanilino)-2,6-diisopropyl-p-cresol, N,N,N'-tris(3,5-di-isopropyl-4-hydroxybenzyl)ethylenediamine, 1-dimethylamino- 1-(3,5-diisopropyl-4-hydroxyphenyl)-2-butene, α,α'-(N-decylimino)bis(2,6-diisopropyl-p-cresol), 1,3,5-tris(3,5-di-isopropyl-4-hydroxybenzyl)-2,4,6-trimethyl-hexahydrotriazine, N-methyl-N-(3,5-diisopropyl-4-hydroxybenzyl)ethanol amine, 1-dimorpholinomethyl-(3,5-diisopropyl-4-hydroxybenzene, 2-α-methylstyryl-6-methyl-α-dimethylamino-p-cresol, α,α'-(methylimino)-bis(2-α-methylstyryl-6-methyl-p-cresol), 2-α-methylstyryl-6-methyl-α-morpholino-p-cresol, α,α'-(2,6-diethylphenylimino)bis(2-α-methylstyryl-6-methyl-p-cresol), 4,4'-(anilinomethylene)bis(2-α-methylstyryl-o-cresol), α,α',α''-nitrilotris(2-α-methylstyryl-6-methyl-p-cresol), 2-α-methylstyryl-6-methyl-α-tert-butylamino-p-cresol, 2,2'-(3-α-methylstyryl-5-methyl-4-hydroxybenzylimino)diethanol, α,α'-(1,4-piperazinediyl)bis(2-α-methylstyryl-6-methyl-p-cresol), 1,1'-(3-α-methylstyryl-5-methyl-4-hydroxybenzylimino)di-2-ethylhexene, 1,1'-(3-α-methylstyryl-5-methyl-4-hydroxybenzylimino)dicyclohexane, 2-α-methylstyryl-6-methyl-α-(4-methyl-1-piperazinyl)-p-cresol, α,α',α'',α'''-(ethylenedinitrilo)tetrakis(2-α-methylstyryl-6-methyl-p-cresol), α-(p-anilinoanilino)-2-α-methylstyryl-6-methyl-p-cresol, N,N,N'-tris(3-α-methylstyryl-5-methyl-4-hydroxybenzyl)ethylenediamine, 1-dimethylamino-1-(3-α-methylstyryl-5-methyl-4-hydroxyphenyl)-2-butene, α,α'-(N-decylimino)bis(2-α-methylstyryl-6-methyl-p-cresol), 1,3,5-tris(3-α-methylstyryl-5-methyl-4-hydroxybenzyl)-2,4,6-trimethyl-hexahydrotriazine, N-methyl-N-(3-α-methyl-styryl-5-methyl-4-hydroxybenzyl)ethanol amine, 1-dimorpholinomethyl-(3-α-methylstyryl-5-methyl-4-hydroxybenzene,2,6-di-tert-butyl-3-methyl-α-dimethylamino-p-cresol, α,α'-(methylimino)bis(2,6-di-tert-butyl-3-methyl-p-cresol), and all oil-soluble homologs and analogs of such compounds.

Preferred compounds for use as the hydroxybenzyl hydrolysis inhibitors include the N-(3,5-dihydrocarbyl-4-hydroxybenzyl)-N,N-dihydrocarbylamines and the N,N-bis(3,5-dihydrocarbyl-4-hydroxybenzyl)-N-hydrocarbylamines, or mixtures thereof, in which the hydrocarbyl groups each contain no more than 18 carbon atoms. More preferably, the hydrocarbyl groups in the 3- and 5-positions are alkyl groups of up to 8 carbon atoms each, and most preferably they each have up to 4 carbon atoms with at least one of them being tert-butyl.

Typical natural oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, meadowfoam oil, and the like. Such oils may be partially or fully hydrogenated, if desired.

Suitable synthetic oils comprise the esters of dicarboxylic acids (e.g., phthalic acid, succinic acid, maleic acid, azelaic acid, suberic acid, sebacic acid, fumaric acid, adipic acid, mellitic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(-tridecyl) adipate, di(triisodecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, the mixed nonyl/undecyl ester of phthalic acid, and the complex ester formed by reacting one mole of sebacic acid with two moles of tetraethylene glycol and two moles of 2-ethylhexanoic acid.

Other esters which may be used include those made from $C_3$–$C_{18}$ monocarboxylic acids and polyols and polyol ethers such as neopentyl glycol, trimethylolpropane, pentaerythritol and dipentaerythritol. Trimethylolpropane tripelargonate, trimethylolpropane trinonanoate, pentaerythritol tetracaproate, the ester formed from trimethylolpropane and a mixture of octanoic and decanoic acids, the ester formed from trimethylolpropane, caprylic acid and sebacic acid, and the polyesters derived from a $C_4$–$C_{14}$ dicarboxylic acid and one or more aliphatic dihydric $C_3$–$C_{12}$ alcohols such as derived from azelaic acid or sebacic acid and 2,2,4-trimethyl-1,6-hexanediol, serve as examples.

The following examples illustrate the practice and advantages of this invention.

EXAMPLE 1

A commercially available rapeseed oil (Vandemoortele) was subjected to a series of tests in accordance with ASTM D 2619. Analysis of this oil indicated the presence of ca. 0.01–0.03% lecithin. The oil had a total acid number (TAN) of 0.1 mg of KOH/g. In each case the base oil was blended to contain on a weight basis 0.11% of a Primene® 81R salt of diphenylmonothiophosphate, 0.12% Sul-Perm 10S, 0.0075% Cobratec TT-100 triazole additive, 0.05% HiTEC® 536 antirust additive (Ethyl Petroleum Additives, Inc.; Ethyl Petroleum Additives, Ltd.; Ethyl S.A.; Ethyl Canada Ltd.), 0.015% Monacor 39, 0.0735% Naugalube 438L alkylated diphenylamine antioxidant, 0.15% HiTEC® 4735 hindered phenol antioxidant (Ethyl Petroleum Additives, Inc.; Ethyl Petroleum Additives, Ltd.; Ethyl S.A.; Ethyl Canada Ltd.), and 0.075% process oil. The compositions of the foregoing commercially available components and present suppliers of such products are understood to be as follows:

- Primeme 81R—a tert-alkyl primary amine mixture in the $C_{12}$–$C_{14}$ range, Rohm & Haas Company;
- Sul-Perm 10S—a sulphurized ester, Keil Chemical Division of Ferro Corporation;
- Cobratec TT-100—1-H 4/5-methylbenzotriazole, PMC Specialties Group, Cincinnati, Ohio;
- Monacor 39—butanedioic acid, sulpho-1,4-tridecyl ester, sodium salt; Mona Industries, Inc., Paterson, N.J.;
- Naugalube 438L—diphenyl amine nonylated primarily in the 4 and 4' positions, Uniroyal Chemical Company, Inc.;
- HiTEC® 536 antirust additive is a proprietary mixture of components and is available from Ethyl Petroleum Additives, Inc.; Ethyl Petroleum Additives, Ltd.; Ethyl S.A.; and Ethyl Canada Ltd. Included in the tests were blends of this invention which additionally contained specified amounts of N-(3,5-di-tert-butyl-4-hydroxybenzyl)-N,N-dimethylamine. The test procedure (ASTM D 2619) involves agitating the test sample with water at 93° C. for 48 hours. The total acidity of the aqueous layers on completion of the tests (mg of KOH required to neutralize the acids formed) are summarized in the following table.

| N-(3,5-di-tert-butyl-4-hydroxybenzyl)-N,N-dimethylamine, wt % | Total Acidity of Aqueous Layer, mg KOH |
|---|---|
| None | 3.90 |
| 0.05 | 1.41 |
| 0.10 | 0.47 |
| 0.50 | 0 |
| 1.00 | 0 |

EXAMPLE 2

In another pair of tests Conducted with the materials and in the manner of Example 1, a blend without the N-(3,5-di-tert-butyl-4-hydroxybenzyl)-N,N-dimethylamine gave a total acidity in the aqueous layer of 7.7 mg of KOH, whereas a blend which additionally contained 1.0% by weight of N-(3,5-di-tert-butyl-4-hydroxybenzyl)-N,N-dimethylamine gave a zero total acidity in the aqueous layer.

Comparative Example 3

The effect of other additives on the total acidity of the aqueous phase was determined in further tests, each run in duplicate, wherein in lieu of N-(3,5-di-tert-butyl-4-hydroxybenzyl)-N,N-dimethylamine, either lecithin, or a phenolic antioxidant (methylene-bridged alkylphenols, ETHYL ® antioxidant 728), or an amine antioxidant (N,N'-di-sec-butyl-p-phenylene diamine) was employed in the same rapeseed oil blends as in Example 1. The results of these 5 tests (ASTM D 2619) are summarized in the following table.

| Additive & Amount Used, wt % | Total Acidity of Aqueous Layer, mg KOH |
|---|---|
| Lecithin, 1.0% | 17.22; 13.30 |
| Phenolic antioxidant, 1.0% | 4.04; 2.02 |
| Amine antioxidant, 1.0% | 5.78; 4.57 |

EXAMPLE 4

The procedure of Example 1 was repeated using two blends each containing 0.5% by weight of N-(3,5-di-tert-butyl-4-hydroxybenzyl)-N,N-dimethylamine in rapeseed oils containing the same additional additives of Example 1 at the concentration levels as set forth therein. One such blend was formulated in a rapeseed oil (Calgene) having a high content of erucic acid glycerides (note Pub. No. WO 88/05808). The other such blend was formulated in a low erucic acid rapeseed oil (EVVA). The results are summarized in the following table.

| Type of Rapeseed Oil Used | Total Acidity of Aqueous Layer, mg KOH |
|---|---|
| High erucic acid type | 0.92 |
| Low erucic acid type | 0 |

EXAMPLE 5

The effectiveness of N-(3,5-di-tert-butyl-4-hydroxybenzyl)-N,N-dimethylamine in inhibiting hydrolytic degradation of rapeseed oils when used as the sole additive therein was determined by means of the ASTM D 2619 test procedure. Tests were performed on the EVVA rapeseed oil both as received and when it was blended to contain 0.5% by weight of N-(3,5-di-tert-butyl-4-hydroxybenzyl)-N,N-dimethylamine. Likewise, tests were performed on Vandemoortele rapeseed oil as received and on the same oil containing 1.0% by weight of N-(3,5-di-tert-butyl-4-hydroxybenzyl)-N,N-dimethylamine. The results are given in the following table.

| N-(3,5-di-tert-butyl-4-hydroxybenzyl)-N,N-dimethylamine (wt %), & Oil Used | Total Acidity of Aqueous Layer, mg KOH |
|---|---|
| None - EVVA | 8.28 |
| 0.5 - EVVA | 0 |
| None - Vandemoortele | 0.99 |
| 1.0 - Vandemoortele | 0 |

EXAMPLE 6

Another pair of tests was conducted with the formulation of additives as in Example 1 using a rapeseed oil from Raision Tehtaat Oy AB. One such blend, devoid of N-(3,5-di-tert-butyl-4-hydroxybenzyl)-N,N-dimethylamine, gave a total acidity in the aqueous layer of 4.2 mg KOH. The same blend but which additionally contained 0.5% by weight of N-(3,5-di-tert-butyl-4-hydroxybenzyl)-N,N-dimethylamine gave a zero total acidity in the aqueous layer.

The copper rod performance of the test blends of the foregoing Examples 1–6, although deemed of less relevance to the issue of hydrolytic degradation than total acidity, are summarized in the following table. For ease of reference, the rapeseed base oils are therein identified as follows: V=Vandemoortele, C=Calgene Chemical, E=EVVA, and R=Raision Tehtaat Oy AB, and the oils designated as fully formulated contained the additive complement set forth in Example 1:

| HiTEC ® 4703 Additive, wt % and Oil Used | Fully Formulated | ASTM D 2619 Copper Wt. Loss, mg/cm$^2$ | ASTM D 2619 Copper Rating |
|---|---|---|---|
| None - V | Yes | 0.03 | 1b |
| 0.05 - V | Yes | 0.011 | 2b |
| 0.10 - V | Yes | 0.014 | 1b |
| 0.50 - V | Yes | 0.011 | 1a |
| 1.00 - V | Yes | 0.1 | 1b |
| None - V | Yes | 0.013 | 1b |
| 1.00 - V | Yes | 0.12 | 1a |
| 0.50 - C | Yes | 0.05 | 2c |
| 0.50 - E | Yes | 0.009 | 1a |
| None - E | No | 0.09 | 1b |
| 0.50 - E | No | 0.02 | 1a |
| None - V | No | 0.04 | 1b |
| 1.00 - V | No | 0.015 | 1b |
| None - R | Yes | 0.073 | 1b/2a |
| 0.50 - R | Yes | 0.024 | 1a |

It will be noted that all of the above copper corrosion test results are in compliance with the Hagglunds Denison HF-2 and HF-0 hydraulic oil specifications.

As is clear from the above, the compositions of this invention can contain any of a wide variety of additives which are soluble or at least dispersible in the base oil(s) being employed in any given situation.

As noted above, preferred compositions of this invention involve use of combinations of additives, namely a) a combination of (i) at least one oil-soluble 3,5-dihydrocarbyl-4-hydroxybenzyl stabilizer of this invention and (ii) at least one oil-soluble rust inhibitor;

b) a combination of (i) at least one oil-soluble 3,5-dihydrocarbyl-4-hydroxybenzyl stabilizer of this invention, (ii) at least one oil-soluble rust inhibitor, and (iii) at least one oil-soluble antioxidant;

c) a combination of (i) at least one oil-soluble 3,5-dihydrocarbyl-4-hydroxybenzyl stabilizer of this invention, (ii) at least one oil-soluble rust inhibitor, (iii) at least one oil-soluble antioxidant, and (iv) at least one oil-soluble phosphorus-containing and/or sulphur-containing antiwear and/or extreme pressure agent;

d) a combination of (i) at least one oil-soluble 3,5-dihydrocarbyl-4-hydroxybenzyl stabilizer of this invention, (ii) at least one oil-soluble rust inhibitor, (iii) at least one oil-soluble antioxidant, (iv) at least one oil-soluble phosphorus-containing and/or sulphur-containing antiwear and/or extreme pressure agent, and (v) at least one oil-soluble copper corrosion inhibitor.

Rust Inhibitors

The rust inhibitor used in these preferred combinations may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, or oleic acid, or linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid, and the like; long-chain $\alpha,\omega$-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. The corresponding half amides of such alkenyl succinic acids are also useful. Although added in acidic form, some or all of the carboxylic groups of these carboxylic acid type corrosion inhibitors may be neutralized for example by excess amine if present in the compositions. Imides and amides of alkenyl succinic acids and anhyrides having 8 to 24 carbon atoms in the alkenyl group are useful corrosion inhibitors, for example, the reaction product of dodecenyl succinic acid or anhydride with a polyethylene polyamine, further reacted with a fatty acid such as oleic acid. Other suitable corrosion inhibitors include ether amines; acid phosphates; amines; polyethoxylated compounds such as ethoxylated amines, ethoxylated phenols, and ethoxylated alcohols; imidazolines; and the like. Materials of these types are well known to those skilled in the art and a number of such materials are available as articles of commerce.

Still other useful corrosion inhibitors are aminosuccinic acids or derivatives thereof represented by the formula:

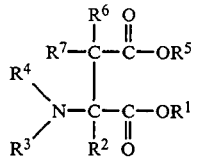

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred of the aminosuccinic acid derivatives is a dialkyl ester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

Supplemental Antioxidants

Notwithstanding the fact that many of the hydroxybenzyl hydrolysis inhibitors are themselves antioxidants, it is often preferable to include in the oleaginous compositions of this invention a conventional quantity of one or more other antioxidants in order to protect the composition from premature degradation in the presence of air, especially at elevated temperatures. Thus reference in this disclosure to antioxidants is in connection with substances used in addition to the hydroxybenzyl hydrolysis inhibitor. Typical antioxidants include hindered phenolic antioxidants, secondary aromatic amine antioxidants, sulphurized phenolic antioxidants, oil-soluble copper compounds, phosphorus-containing antioxidants, and the like.

Illustrative sterically hindered phenolic antioxidants include ortho-alkylated phenolic compounds such as 2,6-di- tertbutylphenol, 4-methyl-2,6-di-tert-butylphenol, 2,4,6-tri-tertbutylphenol, 2-tert-butylphenol, 2,6-diisopropylphenol, 2-methyl-6-tert-butylphenol, 2,4-dimethyl-6-tert-butylphenol, 4-ethyl-2,6-di-tert-butylphenol, 2,6-di-(1,1,3,3-tetramethylbutyl)phenol, 2-methyl-6-(1,1,3,3-tetramethylbutyl)phenol, 2-methyl-6-styrylphenol, 2,6-di-styryl-4-nonylphenol, and their analogs and homologs. Mixtures of two or more such mononuclear phenolic compounds are also suitable.

Also useful are methylene-bridged alkylphenols, and these can be used singly or in combinations with each other, or in combinations with sterically-hindered unbridged phenolic compounds. Illustrative methylene-bridged compounds include 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylenebis(2,6-di-tert-butylphenol), and similar compounds. Preferred are mixtures of methylene- bridged alkylphenols such as are described in U.S. Pat. No. 3,211,652.

Amine antioxidants, especially oil-soluble aromatic secondary amines can also be used. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-α-naphthylamine, phenyl-β-naphthylamine, alkyl- or aralkyl-substituted phenyl-α-naphthylamine containing one or two alkyl or aralkyl groups each having up to about 16 carbon atoms, alkyl- or aralkyl-substituted phenyl-β-naphthylamine containing one or two alkyl or aralkyl groups each having up to about 16 carbon atoms, and similar compounds.

A preferred type of aromatic amine antioxidant is an alkylated diphenylamine of the general formula

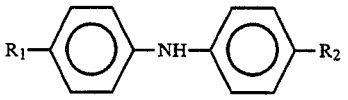

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominately a 4,4'-dinonyldiphenylamine (i.e., bis(4-nonylphenyl)amine) wherein the nonyl groups are branched.

Another useful type of antioxidant for inclusion in the compositions of this invention is comprised to one or more liquid, partially sulphurized phenolic compounds such as are prepared by reacting sulphur monochloride with a liquid mixture of phenols—at least about 50 weight percent of which mixture of phenols is composed of one or more reactive, hindered phenols—in proportions to provide from about 0.3 to about 0.7 gram atoms of sulphur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15° C. to about 70° C., most preferably between about 40° C. to about 60° C.

Mixtures of different antioxidants can also be used. One suitable mixture is comprised of a combination of (i) an oil-soluble mixture of at least three different sterically-hindered tertiary butylated monohydric phenols which is in the liquid state at 25° C., (ii) an oil-soluble mixture of at least three different ster-ically-hindered tertiary butylated methylene-bridged polyphenols, and (iii) at least one bis(4-alkylphenyl)amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii).

One particularly preferred additive system of this invention is comprised of a combination of (1) at least one sterically hindered 2,6-dihydrocarbyl phenol having a hydrogen atom or a hydrocarbyl group in the 4-position; (2) at least one para-alkylated diphenyl amine; and (3) at least one 3,5-dihydrocarbyl-4-hydroxybenzylamine of the type described above. In these compositions, the weight ratio of these components (excluding diluent oils or the like) is preferably from about 0.01 to 50 parts of (1), and from about 0.01 to 50 parts of (2) per part by weight of (3). Ordinarily, each of the hydrocarbyl groups in the phenols of (1) and of each alkyl substituent of the diphenyl amines of (2) will contain no more than 18 carbon atoms. The phenols of (1) preferably contain alkyl substituents of up to 10 carbon atoms each, and most preferably, tert-butyl groups in the 2- and 6-positions and a hydrogen atom or an alkyl group of up to 10 carbon atoms in the 4-position. The diphenyl amines of (2) preferably contain alkyl substituents in the 4- and 4'-positions, and most preferably these substituents contain from about 8 to 12 carbon atoms each and are usually branched in structure.

A combination of components (1), (2), and (3) as described above, together with (4) at least one oil-soluble triazole or thiazole constitutes a particularly preferred additive combination. Examples of compounds of (4) include benzotriazole, methylbenzotriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles,2,5-bis(hydrocarbylthio)-1,3,4-thiadiazoles, and 2,5-bis(hydrocarbyldithio)-1,3,4-thiadiazoles. The preferred compounds are the triazoles, a number of which are available as articles of commerce. In such combinations, the proportions of (1), (2), and (3) are as above stated, and the amount of (4) is from about 0.001 to about 50 parts by weight per part by weight of (3), again excluding inert diluents or carriers.

Phosphorus-Containing Antiwear and/or Extreme Pressure Agents.

A wide variety of oil-soluble phosphorus-containing substances are suitable for use in the compositions of this invention. Thus use can be made of oil-soluble organic phosphates, organic phosphites, organic phosphonates, organic phosphonites, etc., and their sulphur analogs. Examples include monohydrocarbyl phosphites; monohydrocarbyl phosphates; monohydrocarbyl mono-, di-, and trithiophosphites; monohydrocarbyl mono-, di-, tri-, and tetrathiophosphates; dihydrocarbyl phosphites; dihydrocarbyl phosphates; dihydrocarbyl mono-, di-, and trithiophosphites; dihydrocarbyl mono-, di-, tri-, and tetrathiophosphates; trihydrocarbyl phosphites; trihydrocarbylphosphates; trihydrocarbyl mono-, di-, and trithiophosphites; trihydrocarbyl mono-, di-, tri-, and tetrathiophosphates; the various hydrocarbyl phosphonates and thiophosphonates; the various hydrocarbyl phosphonites and thiophosphonites, and analogous oil-soluble derivatives of polyphosphoric and polythiophosphoric acids; and many others. A few specific examples of such compounds are tributyl phosphate, tri-(2-ethylhexyl) phosphate, trioleyl phosphate, tris(2-chloroethyl) phosphate, tricyclohexyl phosphate, triphenyl phosphate, tricresyl phosphate, cresyl diphenyl phosphate, triethyl phosphite, tributyl phosphite, tris(2-butoxyethyl) phosphite, trioctyl phosphite, tris(tridecyl) phosphite, trilauryl phosphite, triphenyl phosphite, tricresyl phosphite, the mono- or diamyl hydrogen phosphates or mixtures thereof, the mono- or di-2-ethyl-1-hexyl hydrogen phosphates or mixtures thereof, dibutyl hydrogen phosphite, bis(tridecyl) hydrogen phosphite, the diisooctyl ester of butylphosphonic acid, the dihexyl ester of decylphosphonic acid, sulphur-containing analogs of each of the foregoing, dihexyl thiophosphite, diisopropyl dithiophosphate, tris(tridecyl)tetrathiophosphate, and like compounds. Also useful are the oil-soluble heterocyclic phosphorus compounds such as the phosphetanes and thiophosphetanes and their derivatives, such as are described for example in U.S. Pat. Nos. 3,891,726; 3,975,465; *Journal of The Chemical Society, Dalton Transactions,* 1973, pages 1576–1582; 2641–2646; 2701–2707; and Ibid, 1974, pages 633–638.

In this connection, for purposes of this invention a component which contains both phosphorus and sulphur in its chemical structure is deemed a phosphorus-containing antiwear and/or extreme pressure agent rather than a sulphur-containing antiwear and/or extreme pressure agent.

Another type of phosphorus-containing antiwear and/or extreme pressure additives which can be employed in the practice of this invention are the phosphorus- and nitrogen-containing compositions of the type described in G.B. 1,009,913; G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine.

Still another type of phosphorus-containing antiwear and/or extreme pressure additive which can be used in the compositions of this invention is the amine salts of hydroxy-substituted phosphetanes or the amine salts of hydroxy-substituted thiophosphetanes. Typically, such salts are derived from compounds of the formula

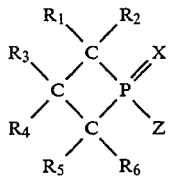

wherein each of $R_1$, $R_2$, $R_3$, $R_4$, $R_5$ and $R_6$ is a hydrogen atom or a carbon-bonded organic group such as a hydrocarbyl group or a substituted hydrocarbyl group wherein the substituent(s) do(es) not materially detract from the predominantly hydrocarbonaceous character of the hydrocarbyl group; X is a sulphur or an oxygen atom and Z is a hydroxyl group or an organic group having one or more acidic hydroxyl groups. Examples of this general type of antiwear and/or extreme pressure agent include the amine salts hydroxyphosphetanes and the amine salts of hydroxy-thiophosphetanes typified by Irgalube 295 additive (Ciba-Geigy Corporation).

Another useful category of phosphorus-containing antiwear and/or extreme pressure agents is comprised of the amine salts of partial esters of phosphoric and thiophosphoric acids. Such compounds may be collectively represented by the formulas

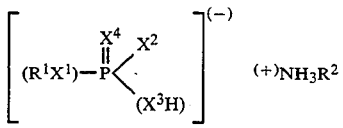

(I)

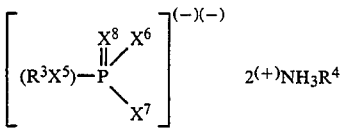

(II)

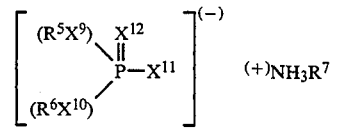

(III)

or mixtures thereof. In Formulas I, II and III, each of $R^1$, $R^2$, $R^3$, $R^4$, $R^5$, $R_6$, and $R^7$ is independently, a hydrocarbyl group and each of $X^1$, $X^2$, $X^3$, $X^4$, $X^5$, $X^6$, $X^7$, $X^8$, $X^9$, $X^{10}$, $X^{11}$, and $X^{12}$ is, independently, an oxygen atom or a sulphur atom.

In one preferred sub-category the amine salts are formed with one or more partially esterified monothiophosphoric acids. These are compounds of Formulas (I) , (II), and (III) above wherein only one of $X^1$, $X^2$, $X^3$, and $X^4$, only one of $X^5$, $X^6$, $X^7$, and $X^8$, and only one of $X^9$, $X^{10}$, $X^{11}$, and $X^{12}$ is a sulphur atom.

In another preferred sub-category the amine salts are formed with one or more partially esterified phosphoric acids. These are compounds of Formulas (I) , (II), and (III) above wherein all of $X^1$, $X^2$, $X^3$, $X^4$, $X^5$, $X^6$, $X^7$, $X^8$, $X^9$, $X^{10}$, $X^{11}$, and $X^{12}$ are oxygen atoms.

Another preferred sub-category of amine salts are those formed with one or more partially esterified dithiophosphoric acids. These are compounds of Formulas (I), (II), and (III) above wherein two of $X^1$, $X^2$, $X^3$, and $X^4$, two of $X^5$, $X^6$, $X^7$, and $X^8$, and two of $X^9$, $X^{10}$, $X^{11}$, and $X^{12}$ are sulphur atoms.

Also useful are amine salts of Formulas (I), (II), and (III) above wherein three or four of $X^1$, $X^2$, $X^3$, and $X^4$, three or four of $X^5$, $X^6$, $X^7$, and $X^8$, and three or four of $X^9$, $X^{10}$, $X^{11}$, and $X^{12}$ are sulphur atoms.

While all of the above oil-soluble amine salts are useful as components in the compositions of this invention, it is most preferred to include at least one oil-soluble amine salt of a dihydrocarbyl monothiophosphoric acid (one sulphur atom per molecule), either alone or in combination with at least one oil-soluble amine salt of a dihydrocarbyl phosphoric acid (no sulphur atom in the molecule).

Suitable salts or amine adducts of the partially esterified monothiophosphoric acids include such compounds as:

Octylamine salt of O-monobutylthiophosphoric acid
Octylamine salt of S-monobutylthiophosphoric acid
Octylamine salt of O-monobutylthionophosphoric acid
Octylamine salt of O,O-dibutylthiophosphoric acid
Octylamine salt of O,S-dibutylthiophosphoric acid
Octylamine salt of O,O-dibutylthionophosphoric acid
Octylamine salt of O-monoisobutylthiophosphoric acid
Octylamine salt of S-monoisobutylthiophosphoric acid Octylamine salt of O-monoisobutylthionophosphoric acid
Octylamine salt of O,O-diisobutylthiophosphoric acid
Octylamine salt of O,S-diisobutylthiophosphoric acid
Octylamine salt of O,O-diisobutylthionophosphoric acid
Octylamine salt of O-monoamylthiophosphoric acid
Octylamine salt of S-monoamylthiophosphoric acid
Octylamine salt of O-monoamylthionophosphoric acid
Octylamine salt of O,O-diamylthiophosphoric acid
Octylamine salt of O,S-diamylthiophosphoric acid
Octylamine salt of O,O-diamylthionophosphoric acid
Octylamine salt of O-monohexylthiophosphoric acid
Octylamine salt of S-monohexylthiophosphoric acid
Octylamine salt of O-monohexylthionophosphoric acid
Octylamine salt of O,O-dihexylthiophosphoric acid
Octylamine salt of O,S-dihexylthiophosphoric acid
Octylamine salt of O,O-dihexylthionophosphoric acid
Octylamine salt of O-monoheptylthiophosphoric acid
Octylamine salt of S-monoheptylthiophosphoric acid
Octylamine salt of O-monoheptylthionophosphoric acid
Octylamine salt of O,O-diheptylthiophosphoric acid
Octylamine salt of O,S-diheptylthiophosphoric acid
Octylamine salt of O,O-diheptylthionophosphoric acid
Octylamine salt of O-mono-2-ethylhexylthiophosphoric acid
Octylamine salt of S-mono-2-ethylhexylthiophosphoric acid
Octylamine salt of O-mono-2-ethylhexylthionophosphoric acid
Octylamine salt of O,O-di-2-ethylhexylthiophosphoric acid
Octylamine salt of O,S-di-2-ethylhexylthiophosphoric acid
Octylamine salt of O,O-di-2-ethylhexylthionophosphoric acid
Octylamine salt of O-monooctylthiophosphoric acid
Octylamine salt of S-monooctylthiophosphoric acid
Octylamine salt of O-monooctylthionophosphoric acid
Octylamine salt of O,O-dioctylthiophosphoric acid
Octylamine salt of O,S-dioctylthiophosphoric acid
Octylamine salt of O,O-dioctylthionophosphoric acid
Octylamine salt of O-monononylthiophosphoric acid
Octylamine salt of S-monononylthiophosphoric acid
Octylamine salt of O-monononylthiophosphoric acid
Octylamine salt of O,O-dinonylthiophosphoric acid
Octylamine salt of O,S-dinonylthiophosphoric acid
Octylamine salt of O,O-dinonylthiophosphoric acid
Octylamine salt of O-monodecylthiophosphoric acid
Octylamine salt of S-monodecylthiophosphoric acid
Octylamine salt of O-monodecylthionophosphoric acid
Octylamine salt of O,O-didecylthiophosphoric acid
Octylamine salt of O,S-didecylthiophosphoric acid
Octylamine salt of O,O-didecylthionophosphoric acid
Octylamine salt of O-monododecylthiophosphoric acid
Octylamine salt of S-monododecylthiophosphoric acid
Octylamine salt of O-monododecylthionophosphoric acid
Octylamine salt of O,O-didodecylthiophosphoric acid
Octylamine salt of O,S-didodecylthiophosphoric acid
Octylamine salt of O,O-didodecylthionophosphoric acid
Octylamine salt of O-monotridecylthiophosphoric acid
Octylamine salt of S-monotridecylthiophosphoric acid
Octylamine salt of O-monotridecylthionophosphoric acid
Octylamine salt of O,O-ditridecylthiophosphoric acid
Octylamine salt of O,S-ditridecylthiophosphoric acid
Octylamine salt of O,O-ditridecylthionophosphoric acid
Octylamine salt of O-monotetradecylthiophosphoric acid
Octylamine salt of S-monotetradecylthiophosphoric acid
Octylamine salt of O-monotetradecylthionophosphoric acid
Octylamine salt of O,O-ditetradecylthiophosphoric acid
Octylamine salt of O,S-ditetradecylthiophosphoric acid
Octylamine salt of O,O-ditetradecylthionophosphoric acid
Octylamine salt of O-monohexadecylthiophosphoric acid
Octylamine salt of S-monohexadecylthiophosphoric acid
Octylamine salt of O-monohexadecylthionophosphoric acid
Octylamine salt of O,O-dihexadecylthiophosphoric acid
Octylamine salt of O,S-dihexadecylthiophosphoric acid
Octylamine salt of O,O-dihexadecylthionophosphoric acid
Octylamine salt of O-monooctadecylthiophosphoric acid
Octylamine salt of S-monooctadecylthiophosphoric acid
Octylamine salt of O-monooctadecylthionophosphoric acid
Octylamine salt of O,O-dioctadecylthiophosphoric acid
Octylamine salt of O,S-dioctadecylthiophosphoric acid
Octylamine salt of O,O-dioctadecylthionophosphoric acid
Octylamine salt of O-monooleylthiophosphoric acid
Octylamine salt of S-monooleylthiophosphoric acid
Octylamine salt of O-monooleylthionophosphoric acid
Octylamine salt of O,O-dioleylthiophosphoric acid
Octylamine salt of O,S-dioleylthiophosphoric acid
Octylamine salt of O,O-dioleylthionophosphoric acid
Octylamine salt of O-monobenzylthiophosphoric acid
Octylamine salt of S-monobenzylthiophosphoric acid
Octylamine salt of O-monobenzylthionophosphoric acid
Octylamine salt of O,O-dibenzylthiophosphoric acid
Octylamine salt of O,S-dibenzylthiophosphoric acid
Octylamine salt of O,O-dibenzylthionophosphoric acid
Octylamine salt of O-monocyclohexylthiophosphoric acid
Octylamine salt of S-monocyclohexylthiophosphoric acid
Octylamine salt of O-monocyclohexylthionophosphoric acid
Octylamine salt of O,O-dicyclohexylthiophosphoric acid
Octylamine salt of O,S-dicyclohexylthiophosphoric acid
Octylamine salt of O,O-dicyclohexylthionophosphoric acid
Octylamine salt of O-monophenylthiophosphoric acid
Octylamine salt of S-monophenylthiophosphoric acid
Octylamine salt of O-monophenylthionophosphoric acid
Octylamine salt of O,O-diphenylthiophosphoric acid
Octylamine salt of O,S-diphenylthiophosphoric acid
Octylamine salt of O,O-diphenylthionophosphoric acid
Octylamine salt of O-mono-p-tolylthiophosphoric acid Octylamine salt of S-mono-p-tolylthiophosphoric acid
Octylamine salt of O-mono-p-tolylthionophosphoric acid
Octylamine salt of O,O-di-p-tolylthiophosphoric acid
Octylamine salt of O,S-di-p-tolylthiophosphoric acid
Octylamine salt of O,O-di-p-tolylthionophosphoric acid
Octylamine salt of O-monoxylylthiophosphoric acid
Octylamine salt of S-monoxylylthiophosphoric acid
Octylamine salt of O-monoxylylthionophosphoric acid
Octylamine salt of O,O-dixylylthiophosphoric acid
Octylamine salt of O,S-dixylylthiophosphoric acid
Octylamine salt of O,O-dixylylthionophosphoric acid
Octylamine salt of O-isopropyl-O-octadecylthiophosphoric acid
Octylamine salt of O-nonyl-S-butylthiophosphoric acid
Octylamine salt of O-undecyl-O-methylthionophosphoric acid
Octylamine salt of O-cyclohexyl-S-decylthiophosphoric acid
Octylamine salt of O-phenyl-S-tetradecylthiophosphoric acid
Octylamine salt of O-pentadecyl-O-cyclohexenylthionophosphoric acid
Octylamine salt of O-ethyl-O-(p-tert-amylphenyl)thionophosphoric acid
Octylamine salt of O-benzyl-S-isononylthiophosphoric acid
Octylamine salt of O-cyclopentyl-O-heptadecylthionophosphoric acid
Octylamine salt of O-oleyl-S-butylthiophosphoric acid
Octylamine salt of O-2-ethylhexyl-O-isooctylthionophosphoric acid
Octylamine salt of O-allyl-S-tridecylthiophosphoric acid.

It will be noted that in the above listing of illustrative amine salts, the partially esterified monothiophosphoric acids have been named, for convenience, by use of the "thio-thiono" system of nomenclature in which thiono refers to a sulphur atom bonded to the phosphorus atom by a double bond whereas thio refers to a sulphur atom that is bonded to the phosphorus atom by a single bond. Such compounds can also be named by use of a "thioic" system of nomenclature. For example, O,O-dihydrocarbylthionophosphoric acid is also known as O,O-dihydrocarbylphosphorothioic acid, $(RO)_2P(S)(OH)$. However, except when referring to specific compounds (as in the above "thio-thiono" listing) the term "monothiophosphoric acid" is used generically herein to refer to phosphoric acid having only one sulphur atom, and that sulphur atom can be bonded to the phosphorus atom either by a single bond or by a double bond. Likewise except when referring to specific compounds, the term "dithiophosphoric acid" refers to phosphoric acid having two sulphur atoms both of which can be bonded to the phosphorus atom by single bonds, or one of which is bonded to the phosphorus atom by a double bond and the other of which is bonded to the phosphorus atom by single bond. The same applies to the term "trithiophosphoric acid", wherein two of the three sulphur atoms can be bonded to the phosphorus atom by single bonds and the third by either a single or double bond.

Illustrative examples of amine salts of partial esters of phosphoric acid include the following:

Octylamine salt of monobutylphosphoric acid
Octylamine salt of dibutylphosphoric acid
Octylamine salt of monoisobutylphosphoric acid
Octylamine salt of diisobutylphosphoric acid
Octylamine salt of monoamylphosphoric acid
Octylamine salt of diamylphosphoric acid
Octylamine salt of monohexylphosphoric acid
Octylamine salt of dihexylphosphoric acid
Octylamine salt of monoheptylphosphoric acid
Octylamine salt of diheptylphosphoric acid
Octylamine salt of mono-2-ethylhexylphosphoric acid
Octylamine salt of di-2-ethylhexylphosphoric acid
Octylamine salt of monooctylphosphoric acid
Octylamine salt of dioctylphosphoric acid
Octylamine salt of monononylphosphoric acid
Octylamine salt of dinonylphosphoric acid
Octylamine salt of monodecylphosphoric acid
Octylamine salt of didecylphosphoric acid
Octylamine salt of monododecylphosphoric acid
Octylamine salt of didodecylphosphoric acid
Octylamine salt of monotridecylphosphoric acid
Octylamine salt of ditridecylphosphoric acid
Octylamine salt of monotetradecylphosphoric acid
Octylamine salt of ditetradecylphosphoric acid
Octylamine salt of monohexadecylphosphoric acid
Octylamine salt of dihexadecylphosphoric acid
Octylamine salt of monooctadecylphosphoric acid
Octylamine salt of dioctadecylphosphoric acid
Octylamine salt of monooleylphosphoric acid
Octylamine salt of dioleylphosphoric acid
Octylamine salt of monobenzylphosphoric acid
Octylamine salt of dibenzylphosphoric acid
Octylamine salt of monocyclohexylphosphoric acid
Octylamine salt of dicyclohexylphosphoric acid
Octylamine salt of mono-p-tolylphosphoric acid
Octylamine salt of di-p-tolylphosphoric acid
Octylamine salt of monoxylylphosphoric acid
Octylamine salt of dixylylphosphoric acid
Octylamine salt of monoisopropyl-monooctadecylphosphoric acid
Octylamine salt of monononyl-monobutylphosphoric acid
Octylamine salt of monoundecyl-monomethylphosphoric acid
Octylamine salt of monocyclohexyl-monodecylphosphoric acid
Octylamine salt of monophenyl-monotetradecylphosphoric acid
Octylamine salt of monopentadecyl-monocyclohexenylphosphoric acid
Octylamine salt of monoethyl-mono(p-tert-amylphenyl)phosphoric acid
Octylamine salt of monobenzyl-monoisononylphosphoric acid
Octylamine salt of monocyclopentyl-monoheptadecylphosphoric acid
Octylamine salt of monooleyl-monobutylphosphoric acid
Octylamine salt of mono-(2-ethylhexyl)-monoisooctylphosphoric acid
Octylamine salt of monoallyl-monotridecylphosphoric acid.

Examples of corresponding amine salts of partially esterified dithiophosphoric acid, of partially esterified trithiophosphoric acid, and of partially esterified tetrathiophosphoric acid will be readily apparent from the above listings.

In addition to the octylamine salts or adducts given above for purposes of illustration, use can be made of the corresponding nonylamine, decylamine, undecylamine, dodecylamine, tridecylamine, tetradecylamine, pentadecylamine, hexadecylamine, heptadecylamine, octadecylamine, cyclohexylamine, phenylamine, mesitylamine, oleylamine, cocoamine, soyamine, $C_8$ tertiary alkyl primary amine, $C_{12-14}$ tertiary alkyl primary amine, $C_{22-24}$ tertiary alkyl primary amine, and phenethylamine salts or adducts of the above and similar partially esterified acids of monothiophosphoric acid, including mixtures of any such compounds. Generally speaking, the preferred amine salts are salts of aliphatic amines, especially the saturated or olefinically unsaturated aliphatic primary amines, such as n-octylamine, 2-ethylhexylamine, tert-octylamine, n-decylamine, the $C_{10}$, $C_{12}$, $C_{14}$ and $C_{16}$ tertiary alkyl primary amines (either singly or in any combinations thereof, such as a mixture of the $C_{12}$ and $C_{14}$ tertiary alkyl primary amines), n-undecylamine, a mixture of $C_{14}$ to $C_{18}$ tertiary alkyl primary amines, lauryl amine, hexadecylamine, heptadecylamine, octadecylamine, the $C_{22}$ and $C_{24}$ tertiary alkyl primary amines (either singly or in combination), decenylamine, dodecenylamine, palmitoleylamine, oleylamine, linoleylamine, eicosenylamine, etc. Secondary hydrocarbyl amines and tertiary hydrocarbyl amines can also be used either alone or in combination with each other or in combination with primary amines. Thus any combination of primary, secondary and/or tertiary amines, whether monoamine or polyamine, can be used in forming the salts or adducts.

Similarly, the amines used can be in the form of polyalkylene polyamines; functionally-substituted polyamines such as a succinimide or succinamide of a polyalkylene polyamines such as a polyisobutenyl succinimide of diethylene triamine, a polyisobutenyl succinimide of triethylene tetramine, a polyisobutenyl succinimide of tetraethylene pentamine, a polyisobutenyl succinimide of pentaethylene hexamine (including succinimides made from commercially available polyethylene polyamine mixtures which contain linear, branched and cyclic species); and Mannich bases derived from polyalkylene polyamines of the types just described. Moreover, the polyalkylene polyamines whether in the free state or in the form of a succinimide, succinamide, or Mannich base, can be partially boronated, partially phosphorylated, or partially acylated with a reagent such as maleic anhydride, malic acid, itaconic acid, itaconic anhydride, thiomalic acid, fumaric acid, and the likes provided that such boronated or phosphorylated or acylated amine or amine moiety contains at least sufficient residual basicity to enable it to form a salt with the partially esterified phosphoric or thiophosphoric acid. Alkylene polyamines in the form of succinimides, succinamides or Mannich bases which have been boronated and phosphorylated are described for example in U.S. Pat. No. 4,857,214.

Use of primary amines is preferred. Especially preferred amines are alkyl monoamines and alkenyl monoamines having from about 8 to about 24 carbon atoms in the molecule.

Amines having less than 8 carbon atoms can be used, including methyl amine, etc., provided the resultant amine salt is oil-soluble. Likewise, amines having more than 24 carbon atoms can be used, again with the proviso that the resultant amine salt is oil soluble.

Methods for the preparation of such amine salts are well known and reported in the literature. See for example, U.S. Pat. Nos. 2,063,629; 2,224,695; 2,447,288; 2,616,905; 3,984,448; 4,431,552; Pesin et al, *Zhurnal Obshchei Khimii*, Vol. 31, No. 8, pp. 2508–2515 (1961); and International Application Publication No. WO 87/07638.

It should be noted that amine salts of partially esterified monothiophosphoric acids are usually made by reacting a mono- and/or dihydrocarbyl phosphite with sulphur or an active sulphur-containing compound such as are referred to above under the caption "Sulphur-Containing Antiwear and/or Extreme Pressure Agents" and one or more primary or secondary amines. Such reactions tend to be highly exothermic reactions which can become uncontrollable, if not conducted properly. One preferred method of forming these amine salts involves a process which comprises (i) introducing, at a rate such that the temperature does not exceed about 60° C., one or more dihydrocarbyl hydrogen phosphites, such as a dialkyl hydrogen phosphite, into an excess quantity of one or more active sulphur-containing materials, such as sulphurized branched-chain olefin (e.g., isobutylene, diisobutylene, triisobutylene, etc.), while agitating the mixture so formed, (ii) introducing into this mixture, at a rate such that the temperature does not exceed about 60° C., one or more aliphatic primary or secondary amines, preferably one or more aliphatic primary monoamines having in the range of about 8 to about 24 carbon atoms per molecule while agitating the mixture so formed, and (iii) maintaining the temperature of the resultant agitated reaction mixture at between about 55° and about 60° C. until reaction is substantially complete. Another suitable way of producing these amine salts is to concurrently introduce all three of the reactants into the reaction zone at suitable rates and under temperature control such that the temperature does not exceed about 60° C. Another preferred way of forming amine salts of partially esterified monothiophosphoric acids is to pre-react elemental sulphur with the amine for a short period of time and then add thereto the appropriate dihydrocarbyl hydrogen phosphite at a rate such that the temperature does not become excessive and the reaction uncontrollable.

Trihydrocarbyl esters of dithiophosphoric acids are another particular group of phosphorus compounds highly suitable for use in the compositions of this invention. The O,O-dihydrocarbyl-S-hydrocarbyl thiothionophosphates (also known as O,O-di-hydrocarbyl-S-hydrocarbyl phosphorothiothionates) which make up this group of preferred additives can be represented by the general formula:

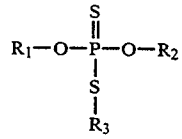

wherein each of $R_1$, $R_2$, and $R_3$ is independently a hydrocarbyl group, especially where $R_3$ is an alicyclic hydrocarbyl group. Particularly preferred are the O,O-dialkyl-S-hydrocarbyl phosphorothiothionates wherein $R_3$ is an alicyclic group an $R_1$ and $R_2$ are alkyl groups each having up to about 18 carbon atoms and most preferably up to about 12 carbon atoms.

These compounds can be made by various known methods. Probably the most efficacious method involves reacting phosphorus pentasulphide ($P_2S_5$, often regarded as $P_4S_{10}$) with the appropriate alcohols or mixture of alcohols. Compounds in which one of the hydrocarbyl groups differs from the other two are preferably made by first reacting the phosphorus pentasulphide with an appropriate alcohol to form an intermediate product, viz. $(RO)_2PSSH$, which in turn is reacted with a compound containing at least one reactive olefinic double bond. Note, for example, U.S. Pat. Nos. 2,528,732, 2,561,773, 2,665,295, 2,767,206, 2,802,856, 3,023,209, and *J. Org. Chem.*, 1963, 28, 1262-8.

Exemplary compounds suitable for use in the compositions of this invention include such compounds as trioctylphosphorothiothionate, tridecylphosphorothiothionate, trilaurylphosphorothiothionate, O,O-diethyl bicyclo[2.2.1]-hepten-2-yl phosphorothiothionate, O,O-diethyl-7,7-dimethyl-bicyclo[2.2.1]-5-hepten-2-yl phosphorothiothionate, the product formed by reaction of dithiophosphoric acid-O,O-dimethyl ester with cis-endomethylene-tetrahydrophthalic acid dimethyl ester, the product formed by reaction of dithiophosphoric acid-O,O-dimethyl ester with cis-endomethylene-tetrahydrophthalic acid dibutyl ester, the product formed by reaction of dithiophosphoric acid-O,O-dibutyl ester with cis-endo-methylene-tetrahydrophthalic acid dilauryl ester, the product formed by reaction of dithiophosphoric acid-O,O-dimethyl ester with 2,5- endomethylene-1-methyl-tetrahydrobenzoic acid butyl ester, the product formed by reaction of dithiophosphoric acid-O,O-dimethyl ester with 2,5-endomethylene-1- methyl-tetrahydrobenzoic acid decyl ester, the product formed by reaction of dithiophosphoric acid-0,0-dimethyl ester with 2,5-endomethylene-6- methyl-tetrahydrobenzoin acid ethyl ester, the product formed by reaction of dithiophosphoric acid-O,O-diethyl ester with 2,5-endomethylene-tetrahydrobenzyl alcohol, the product formed by reaction of dithiophosphoric acid-O,O-dimethyl ester with the Dieis-Alder adduct of cyclopentadiene and allyl alcohol (2 mols:1 mol), the product formed by reaction of dithiophosphoric acid-O,O-dimethyl ester with 2,5-endomethylene-tetrahydrophenyl acetate, the product formed by reaction of dithiophosphoric acid-O,O-dibutyl ester with the Dieis-Alder adduct of cyclopentadiene and vinyl acetate (2 mols:1 mol), the product formed by reaction of dithiophosphoric acid-O,O-dimethyl ester with the bis-cyclopentadiene adduct of p-benzoquinone, the product formed by reaction of dithiophosphoric acid-O,O-dimethyl ester with the azodicarboxylic acid diethyl ester, the product formed by reaction of dithiophosphoric acid-O,O-dimethyl ester with dicyclopentadiene, the product formed by reaction of dithiophosphoric acid-O,O-dibutyl ester with dicyclopentadiene, the product formed by reaction of dithiophosphoric acid-O,O-dioctyl ester with dicyclopentadiene, the product formed by reaction of dithiophosphoric acid-O,O-dilauryl ester with dicyclopentadiene, the product formed by reaction of dithiophosphoric acid-O,O-di-2-ethylhexyl ester with wax olefin, the product formed by reaction of dithiophosphoric acid-O,O-di-2-ethylhexyl ester with oleyl alcohol, the product formed by reaction of dithiophosphoric acid-O,O-di-2-ethylhexyl ester with linseed oil, the product formed by reaction of dithiophosphoric acid-O,O-diamyl ester with alpha pinene, the product formed by reaction of dithiophosphoric acid-O,O-diphenyl ester with alpha pinene, the product formed by reaction of dithiophosphoric acid-O,O-diamyl ester with allo-ocimene, the product formed by reaction of dithiophosphoric acid-O,O-dioctyl ester with dipentene, the product formed by reaction of dithiophosphoric acid-O,O-diisopropyl ester with styrene, propene, isobutene, 1-octene, methylcyclohexene, butadiene, isoprene, dipentene, etc., and the like.

Sulphur-Containing Antiwear and/or Extreme Pressure Agents

A variety of oil-soluble metal-free sulphur-containing antiwear and/or extreme pressure additives can be used in the practice of this invention. Examples are included within the categories of dihydrocarbyl polysulphides; sulphurized olefins; sulphurized fatty acid esters of both natural and synthetic origins; trithiones; sulphurized thienyl derivatives; sulphurized terpenes; sulphurized oligomers of $C_2$–$C_8$ monoolefins; and sulphurized Diels-Alder adducts such as those disclosed in U.S. Pat. No. Re. 27,331. Specific examples include sulphurized polyisobutene of Mn 1,100, sulphurized isobutylene, sulphurized diisobutylene, sulphurized triisobutylene, dicyclohexyl polysulphide, diphenyl polysulphide, dibenzyl polysulphide, dinonyl polysulphide, and mixtures of di-tert-butyl polysulphide such as mixtures of di-tert-butyl trisulphide, di-tert-butyl tetrasulphide and di-tert-butyl pentasulphide, among others. Combinations of such categories of sulphur-containing antiwear and/or extreme pressure agents can also be used, such as a combination of sulphurized isobutylene and di-tert-butyl trisulphide, a combination of sulphurized isobutylene and dinonyl trisulphide, a combination of sulphurized tall oil and dibenzyl polysulphide, and the like.

Because of the toxicity of hydrogen sulphide, it is preferable to utilize in the practice of this invention oil-soluble sulphur-containing antiwear and/or extreme pressure agents, and more preferably oil-soluble active sulphur-containing antiwear and/or extreme pressure agents, that yield less than 25 ppm, and more preferably less than 10 ppm, of vapor space $H_2S$ when heated in the concentrated state for one week at 65° C. Most preferred are materials of this type which yield no detectable vapor space $H_2S$ when tested under these conditions.

Copper Corrosion Inhibitors

One type of such additives is comprised of thiazoles, triazoles and thiadiazoles. Examples of such compounds include benzotriazole, tolyltriazole, octyltriazole, decyltriazole, dodecyltriazole, 2-mercaptobenzothiazole, 2,5-dimercapto-3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyldithio)-1,3,4-thiadiazoles, a number of which are available as articles of commerce. Such compounds are generally synthesized from hydrazine and carbon disulphide by known procedures. See for example U.S. Pat. Nos. 2,749,311; 2,760,933; 2,765,289; 2,850,453; 2,910,439; 3,663,561; 3,862,798; 3,840,549; and 4,097,387.

Other suitable inhibitors of copper corrosion include ether amines; polyethoxylated compounds such as ethoxylated amines, ethoxylated phenols, and ethoxylated alcohols; imidazolines; and the like. Materials of these types are well known to those skilled in the art and a number of such materials are available as articles of commerce.

Additional preferred embodiments are those in which the composition contains at least one, and more preferably, a plurality of the following respective additive components A) through K):

A) Ashless Dispersants

Any of a variety of ashless dispersants can be utilized in the compositions of this invention. These include carboxylic ashless dispersants, Mannich base ashless dispersants, polymeric polyamine dispersants, and post-treated dispersants of any of these types.

Carboxylic ashless dispersants are reaction products of an acylating agent (e.g., a monocarboxylic acid, dicarboxylic acid or other polycarboxylic acid, or derivatives thereof) with one or more polyamines and/or polyhydroxy compounds. These products, are described in many patents, including British Patent Specification 1,306,529 and the following U.S. Pat. Nos.: 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and Re. 26,433.

There are a number of sub-categories of carboxylic ashless dispersants. One such sub-category which constitutes a preferred type is composed of the polyamine succinamides and more preferably the polyamine succinimides in which the succinic group contains a hydrocarbyl substituent, usually an alkenyl substituent, containing at least 30 carbon atoms. These dispersants are usually formed by reacting a polyamine with an alkenyl succinic acid or anhydride such as a polyisobutenyl succinic acid and anhydride wherein the polyisobutenyl group has a number average molecular weight of 500 to 5,000, preferably 700 to 2,500, more preferably 700 to 1,400, and typically in the range of 800 to 1,300. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. Representative examples of such dispersants are given in U.S. Pat. Nos. 3,172,892; 3,202,678; 3,216,936; 3,219,666; 3,254,025; 3,272,746; and 4,234,435. As used herein the term "succinimide" is meant to encompass the completed reaction product from reaction between the amine reactant(s) and the hydrocarbon-substituted carboxylic acid or anhydride (or like acid derivative) reactant(s), and is intended to encompass compounds wherein the product may have amide, amidine, and/or salt linkages in addition to the imide linkage of the type that results from the reaction of a primary amino group and an anhydride moiety.

Another sub-category of carboxylic ashless dispersants which can be used in the compositions of this invention includes alkenyl succinic acid esters and diesters of alcohols containing 1–20 carbon atoms and 1–6 hydroxyl groups. Representative examples are described in U.S. Pat. Nos. 3,331,776; 3,381,022; and 3,522,179. The alkenyl succinic portion of these esters corresponds to the alkenyl succinic portion of the succinimides described above. Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g., $C_1$–$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

Still another sub-category of carboxylic ashless dispersants useful in forming compositions of this invention comprises an alkenyl succinic ester-amide mixture. These may be made by heating the above-described alkenyl succinic acids, anhydrides or lower alkyl esters or etc. with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1–20 carbon atoms, 1–6 hydroxy groups and 1–4 amine nitrogen atoms. Examples are ethanolamine, diethanolamine, N-ethanol-diethylene triamine, and trimethylol aminomethane. Representative examples of suitable ester-amide mixtures are referred to in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

As in the case of the other carboxylic ashless dispersants discussed above, the alkenyl succinic anhydride or like acylating agent is derived from a polyolefin, preferably a polyisobutene, having a number average molecular weight of 500 to 5,000, preferably 700 to 2,500, more preferably 700 to 1,400, and especially 800 to 1,200. Likewise, residual unsaturation in the polyalkenyl substituent group can be used as a reaction site as for example, by hydrogenation, sulphurization, or the like.

For use in the practice of this invention, the carboxylic ashless dispersant may be boronated (sometimes called "borated") by reaction with a suitable boron compound such a boron acid, a boron ester, a boron oxide, a salt of a boron acid, or the like.

As is well known, Mannich base dispersants are condensation products formed by condensing a long chain hydrocarbon-substituted phenol with one or more aliphatic aldehydes, usually formaldehyde or a formaldehyde precursor, and one or more polyamines, usually one or more polyalkylene polyamines. For use in the practice of this invention, the resultant Mannich base may be boronated by reaction with a suitable boron compound such as a boron acid, a boron ester, a boron oxide, a salt of a boron acid, or the like.

Examples of Mannich condensation products, including in many cases boronated Mannich base dispersants, and methods for their production are described in the following U.S. Pat. Nos.: 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The polyamine group of the Mannich polyamine dispersants is derived from polyamine compounds characterized by containing a group of the structure —NH— wherein the two remaining valances of the nitrogen are satisfied by hydrogen, amino, or organic radicals bonded to said nitrogen atom. These compounds include aliphatic, aromatic, heterocyclic and carbocyclic polyamines. The source of the oil-soluble hydrocarbyl group in the Mannich polyamine dispersant is a hydrocarbyl-substituted hydroxy aromatic compound comprising the reaction product of a hydroxy aromatic compound, according to well known procedures, with a hydrocarbyl donating agent or hydrocarbon source. The hydrocarbyl substituent provides substantial oil solubility to the hydroxy aromatic compound and, preferably, is substantially aliphatic in character. Commonly, the hydrocarbyl substituent is derived from a polyolefin having at least about 40 carbon atoms. The hydrocarbon source should be substantially free from pendant groups which render the hydrocarbyl group oil insoluble. Examples of acceptable substituent groups are halide, hydroxy, ether, carboxy, ester, amide, nitro and cyano. However, these substituent groups preferably comprise no more than about 10 weight percent of the hydrocarbon source.

The preferred hydrocarbon sources for preparation of the Mannich polyamine dispersants are those derived from suitable petroleum fractions or from olefin polymers, preferably polymers of mono-olefins having from 2 to about 30 carbon atoms. The hydrocarbon source can be derived, for example, from polymers of olefins such as ethylene, propene, 1-butene, isobutene, 1-octene, 1-methylcyclohexene, 2-butene and 3-pentene. Also useful are copolymers of such olefins with other polymerizable olefinic substances such as styrene. In general, these copolymers should contain at least 80 percent and preferably about 95 percent, on a weight basis, of units derived from the aliphatic mono-olefins to preserve oil solubility. The hydrocarbon source generally contains at least about 40 and preferably at least about 50 carbon atoms to provide substantial oil solubility to the dispersant. The olefin polymers having a number average molecular weight between about 600 and 5,000 are preferred for reasons of easy reactivity and low cost. However, polymers of higher molecular weight can also be used. Especially suitable hydrocarbon sources are isobutylene polymers.

The Mannich polyamine dispersants are generally prepared by reacting a hydrocarbyl-substituted hydroxy aromatic compound with an aldehyde and a polyamine. The aldehyde is typically an aliphatic aldehyde containing 1 to 7 carbon atoms, and in most cases is formaldehyde or a compound such as formalin or a polyformaldehyde from which formaldehyde is derived during the reaction. Typically, the substituted hydroxy aromatic compound is contacted with from about 0.1 to about 10 moles of polyamine and about 0.1 to about 10 moles of aldehyde per mole of substituted hydroxy aromatic compound. The reactants are mixed and heated to a temperature above about 80° C. to initiate the reaction. Preferably, the reaction is carried out at a temperature from about 100° to about 250° C. The resulting Mannich product has a predominantly benzylamine linkage between the aromatic compound and the polyamine. The reaction can be carried out in an inert diluent such as mineral oil, benzene, toluene, naphtha, ligroin, or other inert solvents to facilitate control of viscosity, temperature, and reaction rate.

Suitable polyamines for use in preparation of the Mannich polyamine dispersants include, but are not limited to, methylene polyamines, ethylene polyamines, propylene polyamines, butylene polyamines, pentylene polyamines, hexylene polyamines and heptylene polyamines. The higher homologs of such amines and related amino-alkyl-substituted piperazines are also useful. Specific examples of such polyamines include ethylene diamine, triethylene tetramine, tris(2-aminoethyl)amine, propylene diamine, pentamethylene diamine, hexamethylene diamine, heptamethylene diamine, octamethylene diamine, decamethylene diamine, di(heptamethylene)-triamine, pentaethylene hexamine, di(trimethylene) triamine, 2-heptyl-3-(2-aminopropyl)imidazoline, 1,3-bis(2-aminoethyl)imidazoline, 1-(2-aminopropyl)piperazine, 1,4-bis(2-aminoethyl)piperazine and 2-methyl-1-(2-aminobutyl)piperazine. Higher homologs, obtained by condensing two or more of the above mentioned amines, are also useful, as are the polyoxyalkylene polyamines.

The most preferred amines are the ethylene polyamines which can be depicted by the formula $$H_2N(CH_2CH_2NH)_nH$$

wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. Commercially available ethylene polyamine mixtures usually contain minor amounts of branched species and cyclic species such as N-aminoethyl piperazine, N,N'-bis-(aminoethyl)piperazine, N,N'-bis(piperazinyl)ethane, and like compounds. The preferred commercial mixtures have approximate overall compositions falling in the range corresponding to diethylene triamine to pentaethylene hexamine, mixtures generally corresponding in overall makeup to tetraethylene pentamine being most preferred. Methods for producing polyalkylene polyamines are known and reported in the literature. See for example U.S. Pat. Nos. 4,827,037; and 4,983,736; and EP Pub. Nos. 412,611; 412,612; 412,613; 412,614; and 412,615, and references cited therein.

The polyalkylene polyamines, examples of which are set forth above, are especially useful in preparing the Mannich polyamine dispersants for reasons of cost and effectiveness. Such polyamines are described in detail under the heading "Diamines and Higher Amines" in Kirk-Othmer, *Encyclopedia of Chemical Technology*, Second Edition, Vol. 7, pp. 22–39. They are prepared most conveniently by the reaction of an ethylene imine with a ring-opening reagent such as ammonia. These reactions result in the production of somewhat complex mixtures of polyalkylene polyamines which include cyclic condensation products such as piperazines. Because of their availability, these mixtures are particularly useful in preparing the Mannich polyamine dispersants. However, it will be appreciated that satisfactory dispersants can also be obtained by use of pure polyalkylene polyamines.

Alkylene diamines and polyalkylene polyamines having one or more hydroxyalkyl substituents on the nitrogen atom are also useful in preparing the Mannich polyamine dispersants. These materials are typically obtained by reaction of the corresponding polyamine with an epoxide such as ethylene oxide or propylene oxide. Preferred hydroxyalkyl-substituted diamines and polyamines are those in which the hydroxyalkyl groups have less than about 10 carbon atoms. Typical examples of suitable hydroxyalkyl-substituted diamines and polyamines include, but are not limited to, N-(2-hydroxyethyl)ethylenediamine, N,N'-bis(2-hydroxyethyl)ethylenediamine, mono(hydroxypropyl)diethylenetriamine, di(hydroxypropyl)tetraethylenepentamine and N-(4-hydroxybutyl)tetramethylenediamine. Higher homologs obtained by condensation of the above mentioned hydroxyalkyl-substituted diamines and polyamines through amine groups or through ether groups are also useful.

Any conventional formaldehyde yielding reagent is useful for the preparation of the Mannich polyamine dispersants. Examples of such formaldehyde yielding reagents are trioxane, paraformaldehyde, trioxymethylene, aqueous formalin and gaseous formaldehyde. Other aldehydes which can be used include acetaldehyde, propionaldehyde, butyraldehyde, isobutyraldehyde, valeraldehyde, hexanal, heptanal, and mixtures of two or more of these.

Typical procedures for producing boronated Mannich base ashless dispersants involve heating one or more such dispersants with at least one boron compound under conditions yielding a boron-containing composition. Suitable compounds of boron useful in forming boronated ashless dispersants suitable for use in the compositions of this invention include, for example, boron acids, boron oxides, boron esters, and amine or ammonium salts of boron acids. Illustrative compounds include boric acid (sometimes referred to as orthoboric acid), boronic acid, tetraboric acid, metaboric acid, pyroboric acid, esters of such acids, such as mono-, di-, and tri-organic esters with alcohols or polyols having up to 20 or more carbon atoms (e.g., methanol, ethanol, 2-propanol, propanol, butanols, pentanols, hexanols, ethylene glycol, propylene glycol, trimethylol propane, diethanol amine, etc.), boron oxides such as boric oxide and boron oxide hydrate, and ammonium salts such as ammonium borate, ammonium pyroborate, etc. While usable, boron halides such as boron trifluoride, boron trichloride, and the like, are undesirable as they tend to introduce halogen atoms into the boronated dispersant, a feature which is detrimental from the environmental, toxicological and conservational standpoints. Amine borane addition compounds and hydrocarbyl boranes can also be used, although they tend to be relatively expensive. The preferred boron reagent is boric acid, $H_3BO_3$.

The most preferred Mannich base dispersants for use in this invention are formed by condensing about one molar proportion of long chain hydrocarbon-substituted phenol with from about 1 to 2.5 moles of formaldehyde and from about 0.5 to 2 moles of polyalkylene polyamine.

The polymeric polyamine dispersants are polymers containing basic amine groups and oil solubilizing groups (for example, pendant alkyl groups having at least about 8 carbon atoms). Such materials include, but are not limited to, interpolymers of decyl methacrylate, vinyl decyl ether or a relatively high molecular weight olefin with aminoalkyl acrylates and aminoalkyl acrylamides. Examples of polymeric polyamine dispersants are set forth in the following patents: U.S. Pat. Nos. 3,329,658; 3,449,250; 3,493,520; 3,519,565; 3,666,730; 3,687,849; and 3,702,300.

The various ashless dispersants referred to above can be subjected to post-treatment with one or more suitable reagents such as urea, thiourea, carbon disulphide, aldehydes, ketones, carboxylic acids, anhydrides of low molecular weight dibasic acids, nitriles, epoxides, phosphorus acids, phosphorus esters, boron compounds, and the like. Such post-treated ashless dispersants can be used in the compositions of this invention. Examples of post-treatment procedures and post-treated ashless dispersants are set forth in the following U.S. Pat. Nos.: 3,036,003; 3,200,107; 3,216,936; 3,256,185; 3,278,550; 3,312,619; 3,366,569; 3,367,943; 3,373,111; 3,403,102; 3,442,808; 3,455,831; 3,455,832; 3,493,520; 3,502,677; 3,513,093; 3,573,010; 3,579,450; 3,591,598; 3,600,372; 3,639,242; 3,649,229; 3,649,659; 3,702,757; and 3,708,522; and 4,971,598.

Mannich-based derivatives of hydroxyaryl succinimides that have been post-treated with $C_5$–$C_9$ lactones such as ε-caprolactone and optionally with other post-treating agents as described for example in U.S. Pat. No. 4,971,711 can also be utilized. See also related U.S. Pat. Nos. 4,820,432; 4,828,742; 4,866,135; 4,866,139; 4,866,140; 4,866,141; 4,866,142; 4,906,394; and 4,913,830 for other similar materials.

B) Amine Salts of Carboxylic Acids

Another component suitable for use in the compositions of this invention is one or more amine salts of one or more long chain carboxylic acids. The acids can be monocarboxylic acids or polycarboxylic acids. Generally speaking, these acids contain from about 8 to about 50 carbon atoms in the molecule and thus the salts are oil-soluble. A variety of amines can be used in forming such salts, including primary, secondary and tertiary amines, and the amines can be monoamines, or polyamines. Further, the amines may be cyclic or acyclic aliphatic amines, aromatic amines, heterocyclic amines, or amines containing various mixtures of acyclic and cyclic groups.

Preferred amine salts include the alkyl and alkenyl amine salts of alkanoic acids and/or alkenoic acids, the alkyl and alkenyl amine salts of alkanedioic acids and/or alkenedioic acids and any combination of the foregoing.

The amine salts are formed by classical chemical reactions, namely, the reaction of an amine or mixture of amines, with the appropriate acid or mixture of acids. Accordingly, further discussion concerning methods for the preparation of such materials would be redundant.

Among the amine salts of long-chain acids that may be used are the following: the octyl amine salt of $C_{36}$ dimer acid (made by dimerization of linoleic acid), lauryl ammonium lau-rate (i.e. the lauryl amine salt of lauric acid), stearyl ammonium laurate, cyclohexyl ammonium laurate, octyl ammonium laurate, pyridine laurate, aniline laurate, lauryl ammonium stearate, stearyl ammonium stearate, cyclohexyl ammonium stearate, octylammonium stearate, pyridine stearate, aniline stearate, lauryl ammonium octanoate, stearyl ammonium octanoate, cyclohexyl ammonium octanoate, octyl ammonium octanoate, pyridine octanoate, aniline octanoate, nonyl ammonium laurate, nonyl ammonium stearate, nonyl ammonium octanoate, lauryl ammonium nonanoate, stearyl ammonium nonanoate, cyclohexyl ammonium nonanoate, octyl ammonium nonanoate, pyridine nonanoate, aniline nonanoate, nonyl ammonium nonanoate, lauryl ammonium decanoate, stearyl ammonium decanoate, cyclohexyl ammonium decanoate, octyl ammonium decanoate, pyridine decanoate, aniline decanoate, decyl ammonium laurate, decyl ammonium stearate, decyl ammonium octanoate, decyl ammonium nonanoate, decyl ammonium decanoate, bis octyl amine salt of suberic acid, bis cyclohexyl amine salt of suberic acid, bis lauryl amine salt of suberic acid, bis stearyl amine salt of suberic acid, bis octyl amine salt of sebacic acid, bis cyclohexyl amine salt of sebacic acid, bis lauryl amine salt of sebacic acid, bis stearyl amine salt of sebacic acid, the tert-dodecyl and tert-tetradecyl primary amine salts of octanoic acid, the tert-decyl and tert-dodecyl primary amine salts of octanoic acid, the tert-dodecyl and tert-tetradecyl primary amine salts of lauric acid, the tert-decyl and tert-dodecyl primary amine salts of lauric acid, the tert-dodecyl and tert-tetradecyl primary amine salts of stearic acid, the tert-decyl and tert-dodecyl primary amine salts of stearic acid, the hexyl amine salt of $C_{24}$-dicarboxylic acid, the octyl amine salt of $C_{28}$-dicarboxylic acid, the octyl amine salt of $C^{30}$-dicarboxylic acid, the decyl amine salt of $C_{30}$-dicarboxylic acid, the octyl amine salt of $C_{32}$-dicarboxylic acid, the bis lauryldimethyl amine salt of traumatic acid, diethyl ammonium laurate, dioctyl ammonium laurate, dicyclohexyl ammonium laurate, diethyl ammonium octanoate, dioctyl ammonium octanoate, dicyclohexyl ammonium octanoate, diethyl ammonium stearate, dioctyl ammonium stearate, diethyl ammonium stearate, dibutyl ammonium stearate, dicyclopentyl ammonium stearate, dipropyl ammonium benzoate, didecyl ammonium benzoate, dimethylcyclohexyl ammonium benzoate, triethyl ammonium laurate, triethyl ammonium octanoate, triethyl ammonium stearate, triethyl ammonium benzoate, trioctyl ammonium laurate, trioctyl ammonium octanoate, trioctyl ammonium stearate, trioctyl ammonium benzoate, and the like. It will be understood of course that the amine salt of the monocarboxylic and/or polycarboxylic acid used should be sufficiently soluble in the base oil used as to provide homogeneous solution at the concentration employed.

Among the preferred amine salts for use in practice of this invention are the primary amine salts of long chain monocarboxylic acids in which the amine thereof is a monoalkyl monoamine, $RNH_2$; the secondary amine salts of long chain monocarboxylic acids in which the amine thereof is a dialkyl monoamine, $R_2NH$; the tertiary amine salts of long chain monocarboxylic acids in which the amine thereof is a trialkyl monoamine, $R_3N$; the bis primary amine salts of long chain dicarboxylic acids in which the amine thereof is a monoalkyl monoamine, $RNH_2$; the bis secondary amine salts of long chain dicarboxylic acids in which the amine thereof is a dialkyl monoamine, $R_2NH$; the bis tertiary amine salts of long chain dicarboxylic acids in which the amine thereof is a trialkyl monoamine, $R_3N$; and mixtures thereof. In the foregoing formulae, R is an alkyl group which contains up to about 30 or more carbon atoms, and preferably from about 6 to about 24 carbon atoms.

C) Demulsifiers

Typical additives which may be employed as demulsifiers include alkyl benzene sulphonates, polyethylene oxides, polypropylene oxides, block copolymers of ethylene oxide and propylene oxide, salts and esters or oil soluble acids, and the like.

Thus, for example use can be made of oxyalkylated trimethylol alkanes with molecular weights in the range of 1,000 to 10,000, and preferably in the range of 3,000 to 8,000. Preferably, the oxyalkylated trimethylol alkane is an oxyalkylated trimethylol ethane or propane, especially where the oxyalkylene groups are composed of a mixture of propyleneoxy and ethylenoxy groups and where these groups are so disposed as to form relatively hydrophobic blocks adjacent the trimethylol group and relatively hydrophilic blocks remote the trimethylol group. Typical oxyalkylated trimethylol propane demulsifiers are described in U.S. Pat. No. 3,101,374. Commercially available products of this type are available from BASF Corporation under the Pluradot trademark. They are available in various molecular weights. Pluradot HA-510 has an average molecular weight of 4,600 and Pluradot HA-530 has an average molecular weight of about 5,300. Pluradot additives are propoxylated and ethoxylated trimethylol propanes.

Another type of suitable demulsifers are oxyalkylated alkyl phenol-formaldehyde condensation products. Typically, these products have molecular weights in the range of about 4,000 to about 6,000 and are comprised of lower alkyl substituted phenol moieties joined together by methylene groups and in which the hydroxyl groups of the phenolic moieties have been ethoxylated. One such commercial product is marketed by Ceca S. A. of Paris, France under the "Prochinor GR77" trade name. The product is supplied as a concentrate in an aromatic solvent and the active ingredient is believed to be an ethoxylated nonylphenol-formaldehyde condensate of molecular weight 4,200 (by gel permeation chromatography calibrated with polystyrene).

Another suitable type of demulsifier is comprised of the tetra-polyoxyalkylene derivatives of ethylene diamine, especially the tetra-poly(oxyethylene)-poly(oxypropylene) derivatives of ethylene diamine. Materials of this type are available commercially from BASF Corporation under the "Tetronics" trademark. Materials of this general type are described in U.S. Pat. No. 2,979,528.

Mixtures of alkylaryl sulphonates, polyoxyalkylene glycols and oxyalkylated alkylphenolic resins, such as are available commercially from Petrolite Corporation under the TOLAD trademark, are also suitable. One such proprietary product, identified as TOLAD 286K, is understood to be a mixture of these components dissolved in a solvent composed of alkyl benzenes. TOLAD 286 is believed to be a similar product wherein the solvent is composed of a mixture of heavy aromatic naphtha and isopropyl alcohol.

Preferred demulsifiers are proprietary materials available from BASF Corporation under the Pluronic trademark. These are block copolymers of propylene oxide and ethylene oxide.

D) Antifoam agents

Suitable antifoam agents include silicones and organic polymers such as acrylate polymers. Various antifoam agents are described in Foam Control Agents by H. T. Kerner (Noyes Data Corporation, 1976, pages 125–176). Mixtures of silicone-type anti-foam agents such as the liquid dialkyl silicone polymers with various other substances are also effective. Typical of such mixtures are silicones mixed with an acrylate polymer, silicones mixed with one or more amines, and silicones mixed with one or more amine carboxylates. Other such mixtures include combinations of a dimethyl silicone oil with (i) a partial fatty acid ester of a polyhydric alcohol (U.S. Pat. No. 3,235,498); (ii) an alkoxylated partial fatty acid ester of a polyhydric alcohol (U.S. Pat. No. 3,235,499); (iii) a polyalkoxylated aliphatic amine (U.S. Pat. No. 3,235,501); and (iv) an alkoxylated aliphatic acid (U.S. Pat. No. 3,235,502).

E) Friction Modifiers

These materials include such substances as the alkyl phosphonates as disclosed in U.S. Pat. No. 4,356,097, aliphatic hydrocarbyl-substituted succinimides derived from ammonia or alkyl monoamines as disclosed in European Patent Publication No. 20,037, dimer acid esters as disclosed in U.S. Pat. No. 4,105,571, oleamide, and the like. Glycerol oleates are another example of fuel economy additives and these are usually present in very small amounts, such as 0.05 to 0.2 weight percent based on the weight of the formulated oil.

Other suitable friction modifiers include aliphatic amines or ethoxylated aliphatic amines, aliphatic fatty acid amides, aliphatic carboxylic acids, aliphatic carboxylic esters, aliphatic carboxylic ester-amides, aliphatic phosphates, aliphatic thiophosphonates, aliphatic thiophosphates, etc., wherein the aliphatic group usually contains above about eight carbon atoms so as to render the compound suitably oil soluble.

A desirable friction modifier additive combination which may be used in the practice of this invention is described in European Patent Publication No. 389,237. This combination involves use of a long chain succinimide derivative and a long chain amide.

F) Seal Swell Agents

Additives may be introduced into the compositions of this invention in order to improve the seal performance (elastomer compatibility) of the compositions. Known materials of this type include dialkyl diesters such as dioctyl sebacate, aromatic hydrocarbons of suitable viscosity such as Panasol AN-3N, products such as Lubrizol 730, polyol esters such as Emery 2935, 2936, and 2939 esters from the Emery Group of Henkel Corp. and Hatcol 2352, 2962, 2925, 2938, 2939, 2970, 3178, and 4322 polyol esters from Hatco Corp. Generally speaking the most suitable diesters include the adipates, azelates, and sebacates of $C_8$–$C_{13}$ alkanols (or mixtures thereof), and the phthalates of $C_4$–$C_{13}$ alkanols (or mixtures thereof). Mixtures of two or more different types of diesters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid.

G) Viscosity Index Improvers

Depending upon the viscosity grade required, the lubricant compositions can contain one or more viscosity index improvers (polymeric materials which are often supplied in the form of a solution in a solvent or carrier fluid). Among the numerous types of materials known for such use are hydrocarbon polymers grafted with, for example, nitrogen-containing polymers, olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate; post-grafted polymers of ethylene-propylene with an active monomer such as maleic anhydride which may be further reacted with an alcohol or an alkylene polyamine; styrene/maleic anhydride polymers post-treated with alcohols and/or amines, and the like.

Dispersant viscosity index improvers, which combine the activity of dispersants and viscosity index improvers, suitable for use in the compositions of this invention are described, for example, in U.S. Pat. Nos. 3,702,300; 4,068,056; 4,068,058; 4,089,794; 4,137,185; 4,146,489; 4,149,984; 4,160,739; and 4,519,929.

When using a viscosity index improver or a dispersant viscosity index improver it is preferred to use a material which exhibits high shear stability as measured by the FZG or Kurt-Orbahn shear stability rigs. Lubrizol 3174 additive (The Lubrizol Corporation) and HiTEC® 630 additive (Ethyl Petroleum Additives Ltd.; Ethyl Petroleum Additives Inc.; Ethyl S. A.; Ethyl Canada Limited) are illustrative of viscosity index improvers having high shear stability.

H) Pour Point Depressants

Another useful type of additive which can be included in compositions of this invention is one or more pour point depressants. The use of pour point depressants in oil-base compositions to improve the low temperature properties of the compositions is well known to the art. See, for example, the books *Lubricant Additives* by C. V. Smalheer and R. Kennedy Smith (Lezius-Hiles Co. Publishers, Cleveland, Ohio, 1967); *Gear and Transmission Lubricants* by C. T. Boner (Reinhold Publishing Corp., New York, 1964); and *Lubricant Additives* by M. W. Ranney (Noyes Data Corporation, New Jersey, 1973). Among the types of compounds which function satisfactorily as pour point depressants in the compositions of this invention are polymethacrylates, polyacrylates, condensation products of haloparaffin waxes and aromatic compounds, and vinyl carboxylate polymers. Also useful as pour point depressants are terpolymers made by polymerizing a dialkyl fumarate, vinyl ester of a fatty acid and a vinyl alkyl ether. Techniques for preparing such polymers and their uses are disclosed in U.S. Pat. No. 3,250,715.

I) Other Metal Corrosion Inhibitors

In order to protect such metals as lead, cadmium, aluminum, magnesium, silver, zinc, and alloys thereof, etc., special corrosion inhibitors can be used. These include such substances as gallic acid esters, phthalic acid esters, and the like.

J) Metal-containing Phosphorus Antiwear and/or Extreme Pressure Agents

Although the use of metal-containing phosphorus antiwear and/or extreme pressure agents is not preferred, nevertheless such compounds can be used in the compositions of this invention, if desired. Generally speaking, the most readily available and widely used metal-containing phosphorus antiwear and/or extreme pressure agents are the metal hydrocarbyl dithiophosphates. As is well known, metal hydrocarbyl dithiophosphates are usually prepared by reacting phosphorus pentasulphide with one or more alcohols or phenolic compounds or diols to produce a hydrocarbyl dithiophosphoric acid which is then neutralized with one or more metal-containing bases. When a monohydric alcohol or phenol is used in this reaction, the final product is a metal dihydrocarbyl dithiophosphate. On the other hand, when a suitable diol (e.g., 2,4-pentanediol) is used in this reaction, the final product is a metal salt of a cyclic hydrocarbyl dithiophosphoric acid. See, for example, U.S. Pat. No. 3,089,850, the disclosure of which is incorporated herein by reference. Thus typical oil-soluble metal hydrocarbyl dithiophosphates used in the compositions of this invention may be represented by the formula

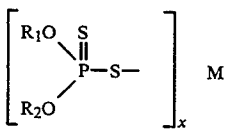

where $R_1$ and $R_2$ are, independently, hydrocarbyl groups or taken together are a single hydrocarbyl group forming a cyclic structure with the phosphorus and two oxygen atoms, preferably a hydrocarbyl-substituted trimethylene group of sufficient carbon content to render the compound oil soluble, M is a metal, and x is an integer corresponding to the valence of M. The preferred compounds are those in which $R_1$ and $R_2$ are separate hydrocarbyl groups (i.e., the metal dihydrocarbyl dithiophosphates). Usually the hydrocarbyl groups of the metal dihydrocarbyl dithiophosphates will contain no more than about 50 carbon atoms each although even higher molecular weight hydrocarbyl groups can be present in the compound. The hydrocarbyl groups include cyclic and acyclic groups, both saturated and unsaturated, such as alkyl, cycloalkyl, alkenyl, cycloalkenyl, aryl, cycloalkylalkyl, aralkyl, and the like. It will be understood that the hydrocarbyl groups may contain elements other than carbon and hydrogen provided such other elements do not detract from the predominantly hydrocarbonaceous character of the hydrocarbyl group. Thus the hydrocarbyl groups may contain ether oxygen atoms, thioether sulphur atoms, secondary or tertiary amino nitrogen atoms, and/or inert functional groups such as esterified carboxylic groups, keto groups, thioketo groups, and the like.

The metals present in the oil-soluble metal dihydrocarbyl dithiophosphates and oil-soluble metal cyclic hydrocarbyl dithiophosphates include such metals as lithium, sodium, potassium, copper, magnesium, calcium, zinc, strontium, cadmium, barium, mercury, aluminum, tin, lead, chromium, molybdenum, tungsten, manganese, iron, cobalt, nickel, ruthenium, etc., as well as combinations of two or more such metals. Of the foregoing, the salts containing group II metals, aluminum, lead, tin, molybdenum, manganese, cobalt, and/or nickel, are preferred. The dihydrocarbyl dithiophosphates of zinc and copper are particularly preferred, with the zinc salts being the most preferred type of compound for use.

The phosphorodithioic acids from which the metal salts are formed can be prepared by the reaction of about 4 moles of one or more alcohols (cyclic or acyclic) or one or more phenols or mixture of one or more alcohols and one or more phenols (or about two moles of one or more diols) per mole of phosphorus pentasulphide, and the reaction may be carried out within a temperature range of from about 50° to about 200° C. The reaction generally is completed in about 1 to 10 hours. Hydrogen sulphide is liberated during the reaction.

Another method for the preparation of the phosphorodithioic acids involves reaction of one or more alcohols and/or one or more phenols with phosphorus sesquisulphide in the presence of sulphur such as is described in PCT International Publication No. WO 90/07512, all disclosure of which is incorporated herein by reference. This reaction is conducted at an elevated temperature, preferably in the range of 85°–150° C. with an overall atomic P:S ratio of at least 2.5:1.

The alcohols used in forming the phosphorodithioic acids by either of the above methods are preferably primary alcohols, or secondary alcohols. Mixtures thereof are also suitable. The primary alcohols include propanol, butanol, isobutyl alcohol, pentanol, 2-ethyl-l-hexanol, isooctyl alcohol, nonanol, decanol, undecanol, dodecanol, tridecanol, tetradecanol, octadecanol, eicosanol, and the like. The primary alcohols may contain various substituent groups such as halogen atoms, nitro groups, etc., which do not interfere with the desired reaction. Among suitable secondary alcohols are included 2-butanol, 2-pentanol, 3-pentanol, 2hexanol, 5-methyl-2-hexanol, and the like. In some cases, it is preferable to utilize mixtures of various alcohols, such as mixtures of 2-propanol with one or more higher molecular weight primary alcohols, especially primary alcohols having from 4 to about 13 carbon atoms in the molecule. Such mixtures preferably contain at least 10 mole percent of 2-propanol, and usually will contain from about 20 to about 90 mole percent of 2-propanol. In one preferred embodiment, the alcohol comprises about 30 to 50 mole percent of 2-propanol, about 30 to 50 mole percent isobutyl alcohol and about 10 to 30 mole percent of 2-ethyl-1-hexanol.

Other suitable mixtures of alcohols include 2-propanol/butanol; 2-propanol/2-butanol; 2-propanol/2-ethyl-1-hexanol; butanol/2-ethyl-1-hexanol; isobutyl alcohol/2-ethyl-1-hexanol; and 2-propanol/tridecanol.

Cycloaliphatic alcohols suitable for use in the production of the phosphorodithioic acids include cyclopentanol, cyclohexanol, methylcyclohexanol, cyclooctanol, borneol and the like. Preferably, such alcohols are used in combination with one or more primary alkanols such as butanol, isobutyl alcohol, or the like.

Illustrative phenols which can be employed in forming the phosphorodithioic acids include phenol, o-cresol, m-cresol, p-cresol, 4-ethylphenol, 2,4-xylenol, and the like. It is desirable to employ phenolic compounds in combination with primary alkanols such propanol, butanol, hexanol, or the like.

Other alcohols which can be employed include benzyl alcohol, cyclohexenol, and their ring-alkylated analogs.

It will be appreciated that when mixtures of two or more alcohols and/or phenols are employed in forming the phosphorodithioic acid, the resultant product will normally comprise a mixture of three or more different dihydrocarbyl phosphorodithioic acids, usually in the form of a statistical distribution in relation to the number and proportions of alcohols and/or phenols used.

Illustrative diols which can be used in forming the phosphorodithioic acids include 2,4-pentanediol, 2,4-hexanediol, 3,5-heptanediol, 7-methyl-2,4-octanediol, neopentyl glycol, 2-butyl-1,3-propanediol, 2,2-diethyl-1,3-propanediol, and the like.

The preparation of the metal salts of the dihydrocarbyl dithiophosphoric acids or the cyclic hydrocarbyl dithiophosphoric acids is usually effected by reacting the acid product with a suitable metal compound such as a metal carbonate, metal hydroxide, metal alkoxide, metal oxide, or other appropriate metal salt. Simply mixing and heating such reactants is normally sufficient to cause the reaction to occur and the resulting product is usually of sufficient purity for use in the practice of this invention. Typically, the salts are formed in the presence of a diluent such as an alcohol, water or a light mineral oil. Neutral salts are prepared by reacting one equivalent of metal oxide or hydroxide with one equivalent of the acid. Basic metal salts are prepared by adding an excess (i.e., more than one equivalent) of the metal oxide or hydroxide with one equivalent of the dihydrocarbyl phosphorodithioic acid or cyclic hydrocarbyl phosphorodithioic acid.

Illustrative metal compounds which may be used in such reactions include calcium oxide, calcium hydroxide, silver oxide, silver carbonate, magnesium oxide, magnesium hydroxide, magnesium carbonate, magnesium ethoxide, zinc oxide, zinc hydroxide, strontium oxide, strontium hydroxide, cadmium oxide, cadmium hydroxide, cadmium carbonate, barium oxide, aluminum oxide, aluminum propoxide, iron carbonate, copper hydroxide, lead oxide, tin butoxide, cobalt oxide, nickel hydroxide, manganese oxide, and the like.

In some cases, incorporation of certain ingredients such as small amounts of metal acetate or acetic acid in conjunction with the metal reactant will facilitate the reaction and provide an improved product. For example, use of up to about 5% of zinc acetate in combination with the required amount of zinc oxide tends to facilitate the formation of zinc dihydrocarbyl dithiophosphates.

Examples of useful metal salts of dihydrocarbyl dithiophosphoric acids, and methods for preparing such salts are found in the prior art such as for example, U.S. Pat. Nos. 4,263,150; 4,289,635; 4,308,154; 4,322,479; 4,417,990; and 4,466,895.

Generally speaking, the preferred types of metal salts of dihydrocarbyl dithiophosphoric acids are the oil-soluble metal salts of dialkyl dithiophosphoric acids. Such compounds generally contain alkyl groups having at least three carbon atoms, and preferably the alkyl groups contain up to 10 carbon atoms although as noted above, even higher molecular weight alkyl groups are entirely feasible. A few illustrative zinc dialkyl dithiophosphates include zinc diisopropyl dithiophosphate, zinc dibutyl dithiophosphate, zinc diisobutyl dithiophosphate, zinc di-sec-butyl dithiophosphate, the zinc dipentyl dithiophosphates, the zinc dihexyl dithiophosphates, the zinc diheptyl dithiophosphates, the zinc dioctyl dithiophosphates, the zinc dinonyl dithiophosphates, the zinc didecyl dithiophosphates, and the higher homologs thereof. Mixtures of two or more such metal compounds are often preferred for use such as metal salts of dithiophosphoric acids formed from mixtures of isopropyl alcohol and secondary butyl alcohol; isopropyl alcohol, isobutyl alcohol, and 2-ethylhexyl alcohol; isopropyl alcohol, butyl alcohol, and pentyl alcohol; isobutyl alcohol and octyl alcohol; and the like.

K) Metal-containing Detergents

Metal-containing detergents constitute another group of additives which preferably are not employed, but which can be employed, in the compositions of this invention. Such compounds are exemplified by oil-soluble basic salts of alkali or alkaline earth metals with one or more of the following acidic substances (or mixtures thereof): (1) sulfonic acids, (2) carboxylic acids, (3) salicylic acids, (4) alkylphenols, (5) sulphurized alkylphenols, (6) organic phosphorus acids characterized by at least one direct carbon-to-phosphorus linkage. Such organic phosphorus acids include those prepared by the treatment of an olefin polymer (e.g., polyisobutene having a molecular weight of 1000) with a phosphorizing agent such as phosphorus trichloride, phosphorus heptasulphide, phosphorus pentasulphide, phosphorus trichloride and sulphur, white phosphorus and a sulphur halide, or phosphorothioic chloride. The most commonly used salts of such acids are those of sodium, potassium, lithium, calcium, magnesium, strontium and barium. The salts for use in the compositions of this invention should be basic salts having a TBN of at least 50, preferably above 100, and most preferably above 200.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulphide at a temperature of about 50° C., and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulphurized alkylphenol, and condensation products of formaldehyde with a phenolic substance; alcohols such as methanol, 2-propanol, octyl alcohol, Cellosolve alcohol, Carbitol alcohol, ethylene glycol, stearyl alcohol, and cyclohexyl alcohol; and amines such as aniline, phenylenediamine, phenothiazine, phenyl-betanaphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Examples of suitable metal-containing detergents include, but are not limited to, the basic or overbased salts of such substances as lithium phenates, sodium phenates, potassium phenates, calcium phenates, magnesium phenates, sulphurized lithium phenates, sulphurized sodium phenates, sulphurized potassium phenates, sulphurized calcium phenates, and sulphurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates, and magnesium salicylates wherein the aromatic moiety is usually substituted by one or more aliphatic substituents to impart hydrocarbon solubility; the lithium, sodium, potassium, calcium and magnesium salts of hydrolysed phosphosulphurized olefins having 10 to 2000 carbon atoms or of hydrolyzed phosphosulphurized alcohols and/or aliphatic-substituted phenolic compounds having 10 to 2000 carbon atoms; lithium, sodium, potassium, calcium and magnesium salts of aliphatic carboxylic acids and aliphatic-substituted cycloaliphatic carboxylic acids; and many other similar alkali and alkaline earth metal salts of oil-soluble organic acids. Mixtures of basic or overbased salts of two or more different alkali and/or alkaline earth metals can be used. Likewise, basic or overbased salts of mixtures of two or more different acids or two or more different types of acids (e.g., one or more calcium phenates with one or more calcium sulfonates) can also be used. While rubidium, cesium and strontium salts are feasible, their expense renders them impractical for most uses. Likewise, while barium salts are effective, the status of barium as a heavy metal under a toxicological cloud renders barium salts less preferred for present-day usage.

As is well known, overbased metal detergents are generally regarded as containing overbasing quantities of inorganic bases, probably in the form of micro dispersions or colloidal suspensions. Thus the term "oil-soluble" as applied to the metal-containing detergents is intended to include metal detergents wherein inorganic bases are present that are not necessarily completely or truly oil-soluble in the strict sense of the term, inasmuch as such detergents when mixed into base oils behave in much the same way as if they were fully and totally dissolved in the oil.

Collectively, the various basic or overbased detergents referred to hereinabove, have sometimes been called, quite simply, basic alkali metal or alkaline earth metal-containing organic acid salts.

Methods for the production of oil-soluble basic and over-based alkali and alkaline earth metal-containing detergents are well known to those skilled in the art and are extensively reported in the patent literature. See for example, the disclosures of U.S. Pat. Nos. 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,148,740; 4,212,752; 4,617,135; 4,647,387: 4,880,550; GB Published Patent Application 2,082,619 A, and European Patent Application Publication Nos. 121,024 B1 and 259,974 A2.

The above descriptions (A through K inclusive) of other additives which can be used in the compositions of this invention is not to be construed as limitive, as many other types of additives can be used in such compositions. The only requirements are that such other additives not excessively interfere adversely with the performance of the compositions of this invention and that they exhibit suitable compatibility with the additives otherwise being employed therein.

Base oils

This invention can be utilized with any oil of lubricating viscosity that is hydrolyzable, whether such oil is used as the sole base oil or as a component of a base oil blend. When applied to blends, one or more of the oleaginous components of the blend can be hydrolysis-resistant oils provided that the blend contains at least one component that is hydrolyzable within the meaning of this disclosure such that the overall blend itself gives when subjected to the ASTM D 2619 procedure, a total acidity in the aqueous layer greater than is desired or appropriate under the particular circumstances involved. Thus, in some cases a total acidity in the aqueous layer of greater than 6.0 mg KOH may be undesirable. In other cases a value of more than 4.0 mg KOH or more than 3.0 mg KOH or more than 1.0 mg KOH, or even more than 0.5 mg KOH may be undesirable. Indeed, there can be instances where any measurable total acidity is undesirable.

Preferably, the blends will comprise 50 to 100% by volume of hydrolyzable oleaginous base fluid composed of hydrolyzable oleaginous glyceride and/or synthetic ester oil. As noted above, natural glyceride oils containing lecithin can be employed in the practice of this invention.

In general, many natural oils and many synthetic ester oils of the types referred to hereinabove are hydrolyzable, and thus this invention is applicable, inter alia, to such oils whether used singly or in hydrolyzable blends.

The base oil blends can be composed in part of hydrocarbon oils of lubricating viscosity derived from petroleum or tar sands, coal, shale, etc., or synthetic hydrocarbon oils such as hydrogenated polyolefin oils, and poly-$\alpha$-olefins (e.g., hydrogenated or unhydrogenated $\alpha$-olefin oligomers such as hydrogenated poly-1-decene), or blends of such hydrocarbon oils. Other oils that can be used with hydrolyzable oils (e.g., with hydrolyzable natural oils, hydrolyzable ester oils, or hydrolyzable polyalkylene glycol oils, or combinations of any two or all three of these) in forming hydrolyzable blends include; alkyl esters of carbonic or phosphoric acids, polysilicones, and fluorohydrocarbon oils, etc. Thus this invention is applicable to any hydrolyzable oil or oil blend including mixtures of mineral, natural and/or synthetic oils. The term "base oil" for this disclosure includes all the foregoing.

The additive combinations of this invention can thus be used in lubricating oil and functional fluid compositions, such as automotive crankcase lubricating oils, automatic transmission fluids, gear oils, hydraulic oils, cutting oils, etc., in which the base oil of lubricating viscosity is a hydrolyzable base oil.

Mineral oils that can be present in the hydrolyzable blends include mineral oils of appropriate viscosity refined from crude oil of any source including Gulf Coast, Midcontinent, Pennsylvania, California, Alaska, Middle East, North Sea and the like. Standard refinery operations may be used in processing the mineral oil. Among the general types of petroleum oils useful in the forming such blends are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art.

Among the synthetic oils that can be included in hydrolyzable base oil blends are homo- and interpolymers of $C_2$–$C_{12}$ olefins, carboxylic acid esters and polycarboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$–$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls). Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1,000, diphenyl ether of polyethylene glycol having a molecular weight of 500–1,000, diethyl ether of polypropylene glycol having a molecular weight of 1,000–1,500) or mono- and polycarboxylic esters thereof, for example, the acetic acid ester, mixed $C_3$–$C_6$ fatty acid esters, or the $C_{13}$ Oxo acid diester of tetraethylene glycol.

Silicon-based oils such as the polyalkyl-, polyaryl-, polyalkoxy-, or polyaryloxy-siloxane oils and silicate oils comprise another class of synthetic lubricants that can be used in the hydrolyzable blends. Examples include tetraethyl silicate, tetraisopropyl silicate, tetra-(2-ethylhexyl) silicate, tetra-(p-tert-butylphenyl) silicate, poly(methyl)siloxanes, and poly(methylphenyl)siloxanes. Other synthetic lubricating oils for such blends include liquid esters of phosphorus-containing acids (e.g., tricresyl phosphate, trioctyl phosphate, triphenyl phosphite, and diethyl ester of decane phosphonic acid.

Also useful as components of such base oil blends are hydrogenated or unhydrogenated liquid oligomers of $C^6$–$C^{16}$ α-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578. Additionally, hydrogenated 1-alkene oligomers of this type are available as articles of commerce, e.g., under the trade designations ETHYLFLO 162, ETHYLFLO 164, ETHYLFLO 166, ETHYLFLO 168, ETHYLFLO 170, ETHYLFLO 174, and ETHYLFLO 180 poly-α-olefin oils (Ethyl Corporation; Ethyl Canada Limited; Ethyl S.A.). Blends of such materials can also be used in order to adjust the viscometrics of the given hydrolyzable base oil. Suitable 1-alkene oligomers are also available from other suppliers. As is well known, hydrogenated oligomers of this type contain little, if any, residual ethylenic unsaturation.

Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

For some applications, for example use under conditions where oxidative or thermal degradation of the base oil is unlikely to be experienced, unhydrogenated 1-alkene oligomers can be included as a component in a base oil blend.

Likewise, various proprietary synthetic lubricants such as KETJENLUBE synthetic oil of Akzo Chemicals can be employed as a component of the base lubricating oil.

The fact that the base oils used in the compositions of this invention may be composed of (i) one or more hydrolyzable natural oils, (ii) one or more hydrolyzable synthetic oils, (iii) one or more hydrolyzable natural oils in combination with one or more hydrolyzable synthetic oils, (iv) a blend of (i) and one or more non-hydrolyzable oils, (v) a blend of (ii) and one or more non-hydrolyzable oils, (vi) a blend of (iii) and one or more non-hydrolyzable oils, does not mean that these various types of oils are necessarily equivalents of each other. Certain types of base oils may be used in certain compositions for the specific properties they possess such as biodegradability, high temperature stability, non-flammability or lack of corrosivity towards specific metals (e.g. silver or cadmium). In other compositions, other types of base oils may be preferred for reasons of availability or low cost. Thus, the skilled artisan will recognize that while the various types of hydrolyzable base oils or base oil blends discussed above may be used in the compositions of this invention, they are not necessarily functional equivalents of each other in every instance.

Proportions and Concentrations

In general, the components of the additive compositions of this invention are employed in the oleaginous liquids (e.g., lubricating oils and functional fluids) in minor amounts sufficient to improve the performance characteristics and properties of the base oil or fluid. The amounts of the other components will vary in accordance with such factors as the viscosity characteristics of the base oil or fluid used, the viscosity characteristics desired in the finished product, the service conditions for which the finished product is intended, and the performance characteristics desired in the finished product. However, generally speaking, the following concentrations (weight percent) of the components (active ingredients, i.e., excluding diluents which often are associated therewith) in the base oils or fluids are illustrative:

| | Typical Range | Preferred Range |
|---|---|---|
| Hydroxybenzyl hydrolysis inhibitor | 0.005–15 | 0.05–5 |
| Rust inhibitor | 0–2 | 0.002–1 |
| Antioxidant | 0–4 | 0–3 |
| P-contg antiwear/E.P. agent | 0–3 | 0.01–2 |
| S-contg antiwear/E.P. agent | 0–6 | 0.05–4 |
| Cu corrosion inhibitor | 0–0.5 | 0.001–0.2 |
| Ashless dispersant | 0–3 | 0–2 |
| Amine salt of carboxylic acid | 0–1 | 0.001–2 |
| Demulsifier | 0–1 | 0–0.2 |
| Antifoam agent | 0–0.3 | 0–0.1 |
| Friction modifier | 0–3 | 0–1 |
| Seal swell agent | 0–20 | 0–10 |
| Viscosity index improver | 0–20 | 0–15 |
| Pour point depressant | 0–2 | 0–1 |
| Other metal corrosion inhibitor | 0–1 | 0–0.5 |
| Metal-containing antiwear/EP agent | 0–2 | 0–0.5 |
| Metal-containing detergent | 0–2 | 0–0.5 |

For use in hydraulic applications it is of course essential that the additive concentrations are such that air entrainment problems are not encountered.

It is to be noted that some additives are multifunctional additives capable of contributing more than a single property to the blend in which they are used. Thus when employing a multi-functional additive component in the compositions of this invention, the amount used should of course be sufficient to achieve the function(s) and result(s) desired therefrom.

It will be appreciated that the individual components can be separately blended into the base oil or fluid or can be blended therein in various subcombinations, if desired. Moreover, such components can be blended in the form of separate solutions in a diluent. Except for viscosity index improvers and/or pour point depressants (which in many instances are blended apart from other components), it is preferable to blend the other selected components into the base oil by use of an additive concentrate of this invention, as this simplifies the blending operations, reduces the likelihood of blending errors, and takes advantage of the compatibility and solubility characteristics afforded by the overall concentrate.

The additive concentrates of this invention will contain the individual components in amounts proportioned to yield finished oil or fluid blends consistent with the concentrations tabulated above. In most cases, the additive concentrate will contain one or more diluents such as light mineral oils, to facilitate handling and blending of the concentrate. Thus concentrates containing up to 80% by weight of one or more diluents or solvents can be used.

Concentrates of this invention containing one or more of the preferred ancillary components referred to hereinabove will contain the following components in the amounts specified in the following table.

| Component | Typical Concentration, Wt. % | Preferred Concentration, Wt. % |
|---|---|---|
| Hydroxybenzyl hydrolysis inhibitor | 0.1–75 | 0.5–65 |
| Rust inhibitor | 1–25 | 5–20 |
| Supplemental Antioxidant | 0–95 | 0.1–50 |
| Antiwear/E.P. agent | 1–75 | 5–65 |
| Copper Corrosion Inhibitor | 0–15 | 0.1–20 |
| Diluent oil | 0–50 | 0.1–20 |

Additive concentrates such as described in the above table are generally employed in the finished oil in amounts ranging from 0.1 to 25 percent by weight. Preferably the finished oil will contain 0.3 to 20 percent by weight of such concentrates.

As used in the foregoing description, the term "oil-soluble" is used in the sense that the component in question has sufficient solubility in the selected base oil in order to dissolve therein at ordinary temperatures to a concentration at least equivalent to the minimum concentration specified herein for use of such component. Preferably, however, the solubility of such component in the selected base oil will be in excess of such minimum concentration, although there is no requirement that the component be soluble in the base oil in all proportions. As is well known to those skilled in the art, certain useful additives do not completely dissolve in base oils but rather are used in the form of stable suspensions or dispersions. Additives of this type can be employed in the compositions of this invention, provided they do not significantly interfere with the performance or usefulness of the composition in which they are employed.

The oleaginous liquids provided by this invention can be used in a variety of applications. For example, they can be employed as engine oils, gear oils, hydraulic fluids, manual transmission fluids, automatic transmission fluids, cutting and machining fluids, brake fluids, shock absorber fluids, heat transfer fluids, quenching oils, transformer oils, and the like.

The compositions of this invention are particularly suitable for use in connection with fluid power systems powered by hydraulic pumps, such as in automotive and industrial hydraulic fluid systems. The hydraulic pumps are often of the vane-type, piston-type or gear-type, driven singly or in combination. Piston motors or pumps may be axial or radial (high torque). Control in such systems is normally afforded by pressure and directional control valves. Examples of pressure control valves include pressure relief valves, unloading valves, sequence valves, pressure reducer valves and counterbalance valves. Proportional pressure control valves are also important in hydraulic circuits using fluids of this invention. Directional valves may be operated by electronic means and may also be of the proportional type. Servo valves, flow control valves, check valves (direct or pilot operated) are also used. Hydraulic circuits are also fitted with hoses, filters, and reservoirs consistent with the pressure, flow and application of the system.

Hydraulic applications include, for example, hydraulic systems in track laying and construction machinery, vehicles and military equipment, aircraft, winches, cranes, presses, shearing machines, earth-moving equipment, farm equipment, test and gauging stands, and equipment used in waste disposal, environmental engineering, mining, steel manufacturing, waste recycling and similar operations, and many other uses.

What is claimed is:

1. A lubricant or functional fluid composition which comprises:

a) a major proportion of a hydrolyzable oleaginous base fluid in contact with at least a small amount of water, wherein 50 to 100% by volume of said hydrolyzable oleaginous base fluid is composed of hydrolyzable oleaginous glyceride containing lecithin; and b. as a hydrolysis inhibitor and inhibitor of acidity buildup in adventitious water, a minor amount of at least one oil-soluble compound containing at least one 3,5-dihydrocarbyl-4-hydroxybenzyl group attached to a primary, secondary, or tertiary amino nitrogen atom, the two alpha-positions of the benzyl group being substituted by two hydrogen atoms, by two organic groups, or by one hydrogen atom and one organic group, said oil-soluble compound stabilizing said composition against hydrolytic degradation in the presence of moisture.

2. A composition in accordance with claim 1 wherein said glyceride is a rapeseed oil.

3. A composition in accordance with claim 1 further including at least one oil-soluble rust inhibitor.

4. A composition in accordance with claim 3 further including at least one oil-soluble antioxidant in addition to said component b).

5. A composition in accordance with claim 4 further including at least one oil-soluble metal-free phosphorus-containing and/or metal-free sulphur-containing antiwear and/or extreme pressure agent.

6. A composition in accordance with claim 5 further including at least one oil-soluble copper corrosion inhibitor.

7. A composition in accordance with claim 6 wherein said component b) is at least one N-(3,5-dihydrocarbyl-4-hydroxybenzyl)-N,N-dialkylamine.

8. A composition in accordance with claim 3 containing one or more of the following: (i) as an antioxidant in addition to said component b), at least one oil-soluble phenolic antioxidant and at least one oil-soluble aromatic amine antioxidant; (ii) at least one oil-soluble metal-free phosphorus- and nitrogen-containing antiwear and/or extreme pressure agent; (iii) at least one oil-soluble metal-free sulphurized ester; and/or (iv) at least one oil-soluble thiazole or triazole copper corrosion inhibitor.

9. A composition in accordance with claim 8 wherein said composition is essentially free of halogen-containing additive components and wherein the total metal content of metal-containing additives, if any, is 100 ppm or less.

10. A composition in accordance with claim 9 wherein said composition is a hydraulic fluid composition.

11. A method of inhibiting hydrolytic degradation of a hydrolyzable oleaginous lubricant or functional fluid composition in the presence of moisture, which method comprises including in said composition, (a) a minor amount of at least one oil-soluble compound containing at least one 3,5-dihydrocarbyl-4-hydroxybenzyl group attached to a primary, secondary or tertiary amino nitrogen atom, the two alpha-positions of the benzyl group being substituted by two hydrogen atoms, by two organic groups, or by one hydrogen atom and one organic group and (b) a minor amount of (i) at least one oil-soluble rust inhibitor; (ii) at least one oil-soluble antioxidant in addition to said component a; (iii) at least one oil-soluble metal-free phosphorous-containing and/or metal-free sulphur-containing antiwear and/or extreme pressure agent; and (iv) at least one oil-soluble copper corrosion inhibitor, whereby said composition is stabilized against hydrolytic degradation and acid formation in the presence of adventitious water.

12. A method of operating an apparatus which contains an oleaginous lubricant or functional fluid, which method comprises introducing into said apparatus a composition in accordance with claim 8.

13. A method of operating apparatus in accordance with claim 12 wherein the apparatus is a hydraulic system and wherein said oleaginous lubricant or functional fluid composition is a hydraulic fluid.

14. An additive concentrate which comprises: (i) as a hydrolysis inhibitor and inhibitor of acidity build-up in adventitious water, a minor amount of at least one oil-soluble compound containing at least one 3,5-dihydrocarbyl-4-hydroxybenzyl group attached to a primary, secondary or tertiary amino nitrogen atom, the two alpha-positions of the benzyl group being substituted by two hydrogen atoms, by two organic groups, or by one hydrogen atom and one organic group; and (ii) at least one oil-soluble rust inhibitor; and (iii) at least one oil-soluble antioxidant in addition to said component (i); and (iv) at least one oil-soluble metal-free phosphorus-containing and/or metal-free sulphur-containing antiwear and/or extreme pressure agent; and (v) at least one oil-soluble copper corrosion inhibitor.

15. A lubricant or functional fluid composition which comprises:

a. a major proportion of a hydrolyzable oleaginous base fluid in contact with at least a small amount of water; and b. as a hydrolysis inhibitor and inhibitor of acidity buildup in adventitious water, a minor amount of at least one oil-soluble compound containing at least one 3,5-dihydrocarbyl-4-hydroxybenzyl group attached to a primary, secondary, or tertiary amino nitrogen atom, the two alpha-positions of the benzyl group being substituted by two organic groups, or by one hydrogen atom and one organic group, said oil-soluble compound stabilizing said composition against hydrolytic degradation in the presence of moisture.

16. A composition in accordance with claim 15 further including at least one oil-soluble rust inhibitor.

17. A composition in accordance with claim 16 containing one or more of the following: (i) as an antioxidant in addition to said component b), at least one oil-soluble phenolic antioxidant and at least one oil-soluble aromatic amine antioxidant; (ii) at least one oil-soluble metal-free phosphorus- and nitrogen-containing antiwear and/or extreme pressure agent; (iii) at least one oil-soluble metal-free sulphurized ester; and/or (iv) at least one oil-soluble thiazole or triazole copper corrosion inhibitor.

* * * * *